US010147394B2

(12) United States Patent
Song et al.

(10) Patent No.: US 10,147,394 B2
(45) Date of Patent: Dec. 4, 2018

(54) GOA CIRCUITS AND METHOD FOR DRIVING THE SAME, FLEXIBLE DISPLAY APPARATUS AND METHOD FOR CONTROLLING THE DISPLAYING OF THE SAME

(71) Applicant: BOE TECHNOLOGY GROUP CO., LTD, Beijing (CN)

(72) Inventors: Song Song, Beijing (CN); Kazuyoshi Nagayama, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/031,213

(22) PCT Filed: Sep. 18, 2015

(86) PCT No.: PCT/CN2015/089976
§ 371 (c)(1),
(2) Date: Apr. 21, 2016

(87) PCT Pub. No.: WO2016/123983
PCT Pub. Date: Aug. 11, 2016

(65) Prior Publication Data

US 2016/0358586 A1 Dec. 8, 2016

(30) Foreign Application Priority Data

Feb. 5, 2015 (CN) ..... 2015 1 0061067

(51) Int. Cl.
*G09G 3/36* (2006.01)
*G09G 3/30* (2006.01)
(Continued)

(52) U.S. Cl.
CPC ..... *G09G 5/12* (2013.01); *G09G 3/20* (2013.01); *G09G 2300/0408* (2013.01);
(Continued)

(58) Field of Classification Search
CPC ..... G06K 7/1098; G06K 7/10722
See application file for complete search history.

(56) References Cited

U.S. PATENT DOCUMENTS

2003/0090614 A1* 5/2003 Kim ..... G09G 3/3688 349/149
2003/0169247 A1* 9/2003 Kawabe ..... G09G 3/342 345/204

(Continued)

FOREIGN PATENT DOCUMENTS

CN 1584713 A 2/2005
CN 1885395 A 12/2006

(Continued)

OTHER PUBLICATIONS

The World Intellectual Property Organization (WIPO) International Search Report for PCT/CN2015/089976 dated Dec. 10, 2015 pp. 1-4.

(Continued)

*Primary Examiner* — Nan-Ying Yang
(74) *Attorney, Agent, or Firm* — Anova Law Group, PLLC

(57) ABSTRACT

The present disclosure provides a GOA (gate driver on array) circuit for a display screen. The GOA circuit includes at least one GOA group, including a plurality of GOA units connected in series, and a switch control unit configured to transmit control signals. In each of the at least one GOA group, a first-stage GOA unit is connected to a frame-start signal. At least one edge GOA unit is connected to a control signal through the switch control unit. The edge GOA unit being any one of the plurality of GOA units except for the first-stage GOA unit and a last-stage GOA unit.

22 Claims, 17 Drawing Sheets

(51) Int. Cl.

| | |
|---|---|
| ***G06F 3/038*** | (2013.01) |
| ***G09G 5/00*** | (2006.01) |
| ***G09G 5/12*** | (2006.01) |
| ***G09G 3/20*** | (2006.01) |

(52) U.S. Cl.
CPC ..... *G09G 2310/0232* (2013.01); *G09G 2310/0267* (2013.01); *G09G 2310/08* (2013.01); *G09G 2330/021* (2013.01); *G09G 2340/0407* (2013.01); *G09G 2340/0442* (2013.01); *G09G 2380/02* (2013.01)

(56) References Cited

U.S. PATENT DOCUMENTS

| | | | | |
|---|---|---|---|---|
| 2005/0068287 | A1* | 3/2005 | Lin | G09G 3/3677 345/100 |
| 2005/0130783 | A1* | 6/2005 | Standen | F16H 57/08 475/15 |
| 2008/0218502 | A1* | 9/2008 | Lee | G09G 3/3674 345/208 |
| 2009/0051830 | A1* | 2/2009 | Matsushita | G02F 1/133305 348/836 |
| 2009/0102778 | A1 | 4/2009 | Tu et al. | |
| 2010/0128019 | A1 | 5/2010 | Harada | |
| 2014/0300529 | A1 | 10/2014 | Kim et al. | |

FOREIGN PATENT DOCUMENTS

| | | | |
|---|---|---|---|
| CN | 101681074 | A | 3/2010 |
| CN | 101710481 | A | 5/2010 |
| CN | 202210402 | U | 5/2012 |
| CN | 102867477 | A | 1/2013 |
| CN | 202855256 | U | 4/2013 |
| CN | 103399616 | A | 11/2013 |
| CN | 103763409 | A | 4/2014 |
| CN | 103810945 | A | 5/2014 |
| CN | 104637431 | A | 5/2015 |
| CN | 104658466 | A | 5/2015 |
| KR | 1020050001790 | A | 1/2005 |
| WO | 2006137232 | A1 | 12/2006 |

OTHER PUBLICATIONS

The State Intellectual Property Office of the People's Republic of China (SIPO) Office Action 1 for 201510061067.0 dated Oct. 26, 2016 pp. 1-11.

State Intellectual Property Office of the P.R.C (SIPO) Office Action 3 for 201510061067.0 dated Nov. 16, 2017 23 Pages (including translation).

* cited by examiner

GOA CIRCUITS AND METHOD FOR DRIVING THE SAME, FLEXIBLE DISPLAY APPARATUS AND METHOD FOR CONTROLLING THE DISPLAYING OF THE SAME

CROSS-REFERENCES TO RELATED APPLICATIONS

This application is a national phase entry under 35 U.S.C. § 371 of International Application No. PCT/CN2015/089976, filed on Sep. 18, 2015, which claims priority to Chinese Patent Application No. 201510061067.0, filed on Feb. 5, 2014. The above enumerated patent applications are incorporated by reference herein in their entirety.

FIELD OF THE INVENTION

The present invention generally relates to the display technologies and, more particularly, relates to GOA (Gate Driver on Array) circuits and method for driving the same, and a flexible apparatus and method for controlling the display of the same.

BACKGROUND

Nowadays, video files come in various file formats. Many video resolutions (or video video resolutions) such as 408×360, 640×480, 1280×720, 800×600 are commonly used in video files. When a display apparatus is displaying video files with different video resolutions, dark borders or spacing is always displayed at the top, bottom, left, and/or right sides of the screen such that the central area of the screen is more suitable for displaying images with appropriate aspect ratio (i.e., the ratio of width to height) and the displayed images may be of better quality. The display of the dark borders or spacing is often controlled by corresponding GOA units. For example, GOA units may control corresponding TFT (thin-film transistor) rows in the TFT array of the display panel to display the dark border/spacing.

However, for a display apparatus, to accommodate the displayed images according to the video resolution of the video file, dark borders or spacing still need to be displayed on the top, bottom, left and right sides of the screen. Although no images is displayed in the area of the dark borders, it still consumes power to display the dark borders. It is therefore advantageous to reduce the overall power consumption of the display apparatus.

BRIEF SUMMARY OF THE DISCLOSURE

The present invention addresses the above problems in the prior art. The present disclosure provides a GOA (Gate Driver on Array) circuit and method to drive the GOA circuit, and a flexible display apparatus and method for controlling the displaying of the flexible display apparatus. Problems in the prior art, such as high power consumption caused by displaying dark border or spacing can be improved.

One aspect of the present disclosure provides a GOA (gate driver on array) circuit for a display screen. The GOA circuit includes at least one GOA group with a plurality of GOA units connected in series and a switch control unit configured to transmit control signals. In each of the at least one GOA group, a first-stage GOA unit is connected to a frame-start signal. At least one edge GOA unit is connected to a control signal through the switch control unit. The edge GOA unit can be any one of the plurality of GOA units except for the first-stage GOA unit and a last-stage GOA unit.

Optionally, the control signal is configured to turn off the corresponding switch control unit such that GOA units from the corresponding edge GOA unit to the last-stage GOA unit are turned off.

Optionally, a number of the at least one edge GOA unit corresponds to a number of different video resolutions of videos to be displayed in the display screen.

Optionally, the at least one GOA group is divided by one or more edge GOA units to a plurality of display screen areas such that each one of the plurality of display screen areas corresponds to one of a different video resolution.

Optionally, the at least one GOA group is one GOA group positioned at one side of the display screen; and a number of edge GOA units in the GOA group equals to the number of different video resolutions subtracted by 2, the number of different video resolutions being no less than 2.

Optionally, the at least one GOA group includes two GOA groups positioned at two opposing sides of a display screen; and a number of edge GOA units in the GOA group is equal to the number of different video resolutions subtracted by 2, the number of different video resolutions being greater than 2.

Optionally, the switch control unit comprises a thin-film transistor (TFT), a gate of the TFT being connected to the control signal, a first terminal of the TFT being connected to the corresponding edge GOA unit, and a second terminal of the TFT being connected to a previous GOA unit of the corresponding edge GOA unit.

Optionally, when a display screen area corresponding to any one of the at least one GOA group is not needed for displaying images, no frame-start signal is inputted into the first-stage GOA unit.

Optionally, the at least one GOA group includes two or more GOA groups and each one of the two or more GOA groups is controlled separately.

Another aspect of the present disclosure provides a method for driving GOA circuits. The GOA circuit includes at least one GOA group with a plurality of GOA units comprising a first-stage GOA unit, a last-stage GOA unit, and at least one edge GOA unit connected in series, and a switch control configured to transmit a control signal, in each of the at least one GOA group, the first-stage GOA unit being connected to a frame-start signal and the at least one edge GOA unit being connected to the control signal through the switch control unit. The method includes determining the display screen area not needed for displaying images; determining the edge GOA unit corresponding to the display screen area; and turning off the switch control unit connected to the edge GOA unit by turning off corresponding control signals such that GOA units from the edge GOA unit to the last-stage GOA unit are turned off.

Optionally, determining the display screen areas not needed for displaying an image includes determining a current video resolution; and determining display screen areas other than the display screen areas corresponding to the current video resolution as the display screen areas not needed for displaying images.

Optionally, the method further includes adjusting timing to scan a TFT array of the display screen according to the current video resolutions.

Optionally, determining the GOA units corresponding to the display screen areas not needed for displaying images includes determining whether the GOA group is entirely within the display screen areas not needed for displaying images or is partially within the display screen areas not needed for displaying images. If the GOA group is entirely within the display screen areas not needed for displaying images, stopping transmitting the frame-start signal to the first-stage GOA unit of the GOA group. If the GOA group is partially within the display screen areas not needed for displaying images, identifying edge GOA units corresponding to the display screen areas not needed for displaying images.

Optionally, the method further includes turning off switch control units connected to the edge GOA units through the corresponding control signals such that GOA units from the edge GOA units to the last-stage GOA unit in the GOA group are turned off.

Another aspect of the present disclosure further provides a flexible screen display apparatus. The display apparatus includes a flexible display screen and the GOA circuit of claim 1, the flexible display screen including a first region and a second region, the first region including the display screen areas not needed for displaying images, the second region including display screen areas for displaying images, the first region and the second region being controlled by the GOA circuit; and a movable structure connected to at least one side of the flexible display screen.

Optionally, the movable structure includes a pulling unit and a shaft, the pulling unit being connected to the flexible display screen, movement of the pulling unit being arranged to pull the first region of the flexible display screen until the first region and the second region are in different planes.

Optionally, the first region is curved, and the first region is blocked by the second region.

Optionally, the first region is bent at a fixed angle, and the plane containing the first region and the plane containing the second region is configured to form the fixed angle.

Optionally, the first region is configured to wrap around the shaft, and the first region is blocked by the second region.

Optionally, the pulling unit includes a rigid strut and a gearing structure, wherein the rigid strut is connected to the flexible screen; and the gearing structure is configured to drive the rigid strut to move along a first direction or a second direction being opposite to the first direction and to control the rigid strut to maintain stability in directions other than the first direction and the second direction.

Optionally, when the gearing structure is configured to drive the rigid strut to move in the first direction, the rigid strut drives the first region to move until the first region and the second region are in different planes.

Optionally, when the gearing structure is configured to drive the rigid strut to move in the second direction, the rigid strut drives the first region to return to a same plane as the second region.

Optionally, the rigid strut includes a plurality of grooves aligned uniformly on both sides of the rigid strut; the gearing structure includes two gearwheels; each side of the rigid strut is engaged tightly with at least one of the gearwheels through the grooves; and when the gearwheels on both sides of the rigid strut rotate simultaneously, the gearwheels drive the rigid strut to move in the first direction or in the second direction and the gearwheels control the rigid strut to be stable in directions other than the first direction and the second direction.

Optionally, the movable structure includes a resilient strut, one end of the resilient strut being fixed on the shaft, and the other end of the resilient strut being fixed on the pulling unit to buffer movements of the flexible screen around the shaft.

Optionally, a radius of the shaft is greater than or equal to a minimum curving radius of the flexible display screen.

Another aspect of the present disclosure provides a method for controlling the disclosed flexible display apparatus. The method includes determining the first region on the flexible display screen of the flexible display apparatus; and moving the pulling unit of the movable structure in the first direction to pull the first region around the shaft of the movable structure until the first region and the second region on the flexible screen are in different planes.

Optionally, the method for controlling the disclosed flexible display apparatus further includes determining current video resolutions; and determining the first region on the flexible display screen of the display apparatus according to the current video resolutions.

Optionally, receiving control commands with information for determining regions on the flexible display screen; and determining the first region on the flexible display screen of the flexible display apparatus based on the control commands.

Optionally, the first region and the second region are arranged in one of the following configurations: the first region being curved, and the first region being blocked by the second region; the first region being bent at a fixed angle, and the plane containing the first region and the plane containing the second region forming the fixed angle; and the first region being wrapped around the shaft, and the first region being blocked by the second region.

Optionally, the pulling unit includes a rigid strut and a gearing structure; and the rigid strut is connected to the flexible screen.

Optionally, driving, by the gearing structure, the rigid strut to move in the first direction or in a second direction and control the rigid strut to maintain stability in directions other than the first direction and the second direction, the first direction and the second direction being opposite to each other; and pulling, by the rigid strut, the first region to move until the first region and the second region are in different planes when the gearing structure drives the rigid strut to move in the first direction.

Optionally, the method for controlling the disclosed flexible display apparatus further includes pushing, by the rigid strut, the first region to return to a same plane as the second region when the gearing structure drives the rigid strut to move in the second direction.

Optionally, a plurality of grooves are aligned uniformly on both sides of a rigid strut; the gearing structure includes at least two gearwheels; and each side of the rigid strut is engaged tightly with at least one of the gearwheels through the grooves.

Optionally, the method for controlling the disclosed flexible display apparatus further includes driving, by the gearwheels, the rigid strut to move in the first direction or in the second direction when the gearwheels on both sides of the rigid strut rotate simultaneously; and stabilizing, by the rigid strut, the flexible screen in directions other than the first direction and the second direction.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

For those skilled in the art to better understand the technical solution of the invention, reference will now be made in detail to exemplary embodiments of the invention, which are illustrated in the accompanying drawings. Wherever possible, the same reference numbers will be used throughout the drawings to refer to the same or like parts.

One aspect of the present disclosure provides a GOA circuit.

Figure 1:
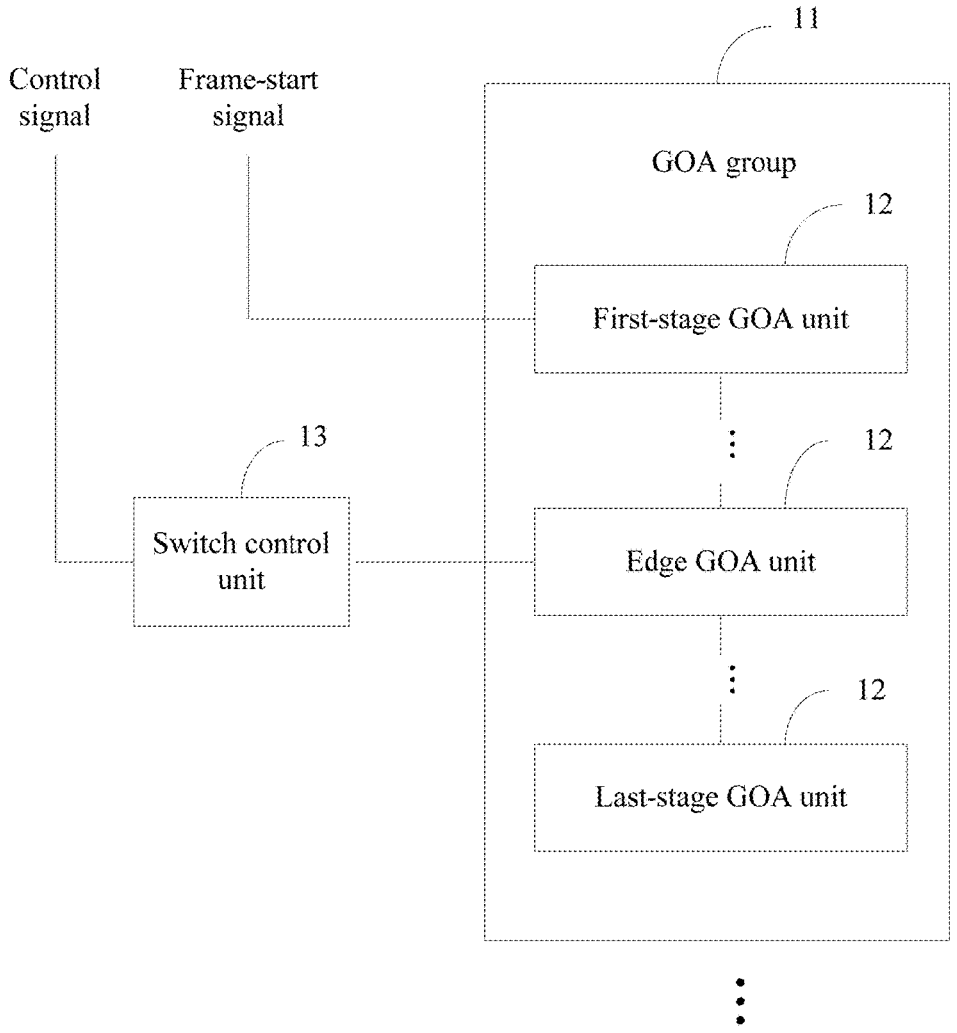
FIG. 1 illustrates block diagram of an exemplary GOA circuit according to the disclosed embodiments of the present disclosure.

The first embodiment provides an exemplary GOA circuit. As shown in FIG. 1, the GOA circuit may include at least one GOA group 11. The GOA group 11 may include multiple GOA units connected in series.

In a GOA group 11, the first-stage GOA unit 12 may be connected to a frame-start signal. At least one edge GOA unit 12 may be connected to a control signal through a switch control cell 13. The edge GOA unit 12, connected to the control signal, may be any other stage of GOA units except for the first-stage GOA unit 12 and the last-stage GOA unit 12 in the GOA group 11. The control signal may be used for controlling the ON and OFF state of the GOA units from the edge GOA unit to the last-stage GOA unit. For example, when the area on the display screen corresponding to the edge GOA unit 12 to the last-stage GOA unit 12 do not needed to be displayed, the control signal may be used to turn off the switch control unit such that the GOA units from the edge GOA unit 12 to the last-stage GOA unit 12 may be turned off (i.e., not in operation). The number of the GOA groups 11 in the GOA circuit is not limited by the embodiments of the present disclosure. The number of the GOA groups 11 may be, for example, 1, 2, or 3. The number of GOA units 12 in each GOA group is also not limited by the embodiments of the present disclosure. The number of GOA units 12 may be, for example, 320, 480, 640, 800, or 1280.

The GOA circuit may be defined as a gate driving circuit, and the GOA group may be defined as a shift register. The shift register may have a plurality of stages or phases for sequentially generating output signals. Thus, the GOA units may be defined according to the plurality of stages. For example, the first-stage GOA unit may be defined as a first stage of the shift register, the last-stage GOA may be defined as a last stage of the shift register, and the edge GOA unit may be defined as any stage of shift register except for the first stage and last stage of the shift register. The output signal generated in each stage may control one corresponding TFT row on the display screen for displaying images.

A GOA unit 12 often corresponds to one TFT row on the display screen. In this disclosure, a TFT row may refer to a row of TFTs in the TFT array controlling the ON and OFF states of the pixels of the display screen.

It should be noted that, when the GOA circuit includes two or more GOA groups, each GOA group could be controlled independently. Any two of the GOA groups are not connected.

Further, in each of the GOA group, a minimum number of edge GOA units are 1 and a maximum number of edge GOA units equal to the total number of GOA units subtracted by two. That is, except for the first-stage GOA unit and the last-stage GOA unit, any of the GOA units in a GOA group can be an edge GOA unit. For example, one GOA group may include four GOA units: GOA 1, GOA 2, GOA 3, and GOA 4. GOA 1 may be the first-stage GOA unit and GOA 4 may be the last-stage GOA unit. One or both of the GOA 2 and GOA 3, between GOA 1 and GOA 4, can be an edge GOA unit.

In one embodiment, the switch control cell 13 may have two functioning states, i.e., the ON state and the OFF state. The control signal may control the functioning states of the switch control cell 13. When the switch control cell 13 is ON, the GOA units 12 in the GOA group 11 connected in series may each function normally and may not be affected by the switch control unit 13. Each TFT row of the display screen, corresponding to a GOA unit, may control the corresponding pixels to display images normally. When the switch control cell 13 is OFF, the GOA units from the edge GOA unit 12 connected to the switch control unit 13 to the last-stage GOA unit 12, may be turned off. The TFT rows on the display screen, corresponding to the GOA units from the edge GOA unit 12 connected to the switch control unit 13 to the last-stage GOA unit 12, may control the corresponding pixels to stop displaying images.

In one embodiment, the number of edge GOA units may be determined by the number of different video resolutions. Further, the at least one GOA group may be divided into a plurality of areas by the at least one edge GOA unit. Each of the areas may correspond to one of the video resolutions.

Figure 2:
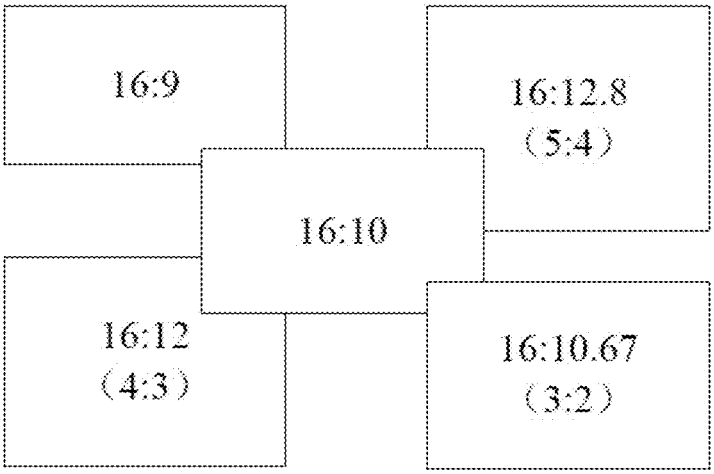
FIG. 2 illustrates exemplary video resolutions according to the disclosed embodiments of the present disclosure.

The number of the different video resolutions is not limited by the embodiment and can be determined according to application requirements. For example, as shown in FIG. 2, five video resolutions, 16:9, 16:10, 3:2, 4:3, and 5:4, may be displayed on the display screen. The video resolution 3:2 may be referred as 16:10.67. The video resolution 4:3 may be referred as 16:12. The video resolution 5:4 may be referred as 16:12.8. As shown in FIG. 2, the video resolutions 16:9, 16:10, 16:10.67, 16:12, and 16:12.8 can be implemented. The five video resolutions can be superimposed on a display screen to obtain five display areas as shown in FIG. 3.

Figure 3:
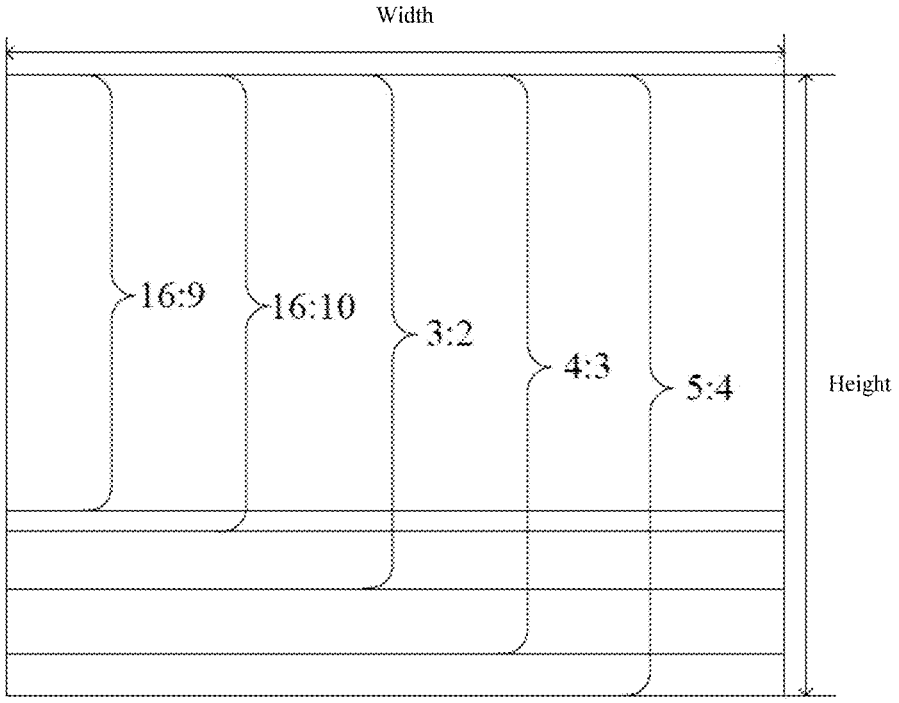
FIG. 3 illustrates video resolutions superimposed on a display screen according to the disclosed embodiments of the present disclosure.

FIG. 3 illustrates the five video resolutions superimposed on a display screen. The display screen, incorporated in a display apparatus, may have a rectangular shape. When the width of the display screen is a fixed value, by increasing the height of the display screen, different video resolutions, which are represented by different rectangular shapes in FIG. 3, can be obtained. FIG. 3 illustrates five superimposed rectangular shapes. The increasing heights of the rectangular shapes may form increasing rectangular display areas corresponding to the five video resolutions of 16:9, 16:10, 3:2, 4:3, and 5:4, respectively. Thus, the location of the edge GOA units can be determined according to the row numbers of the TFT array corresponding to the edges of the five rectangular display areas, and corresponding control signals can be applied on the edge GOA units to obtain the control functions described above.

In one GOA group, a plurality of display areas may be defined according to the edge GOA units. The display areas may include one or more display areas defined by the first-stage GOA unit and the edge GOA units, and the display area defined by the first-stage GOA unit and the last-stage GOA unit (i.e., the display area defined by the GOA group). When a GOA group includes more than one edge GOA units, the first-stage GOA unit and each of edge GOA unit may define/form a display area.

For example, a GOA group may include 1280 GOA units corresponding to 1280 TFT rows, and may include two edge GOA units. One of the edge GOA unit may correspond to the $480^{th}$ TFT row and the other edge GOA unit may correspond to the $800^{th}$ TFT row. The GOA unit corresponding to the first TFT row (i.e., the first-stage GOA unit) and the edge GOA unit corresponding to the $480^{th}$ TFT row may define a first display area. The GOA unit corresponding to the first TFT row and the edge GOA unit corresponding to the $800^{th}$ TFT row may define a second display area. The GOA unit corresponding to the first TFT row and the GOA unit corresponding to the last TFT row (i.e., the $1280^{th}$-stage GOA unit) may define a third display area. The first display area, the second display area, and the third display area may correspond to three video resolutions.

Thus, the number of edge GOA units in the GOA circuit may be determined based on the number of the different video resolutions. Area corresponding to each of the video resolutions may be obtained. The GOA units corresponding to the areas on the display screen that are not needed for displaying images may be turned off to reduce power consumption.

In one embodiment, the at least one GOA group may be one GOA group positioned at any side of the display apparatus. The number of edge GOA units in the GOA group may be the number of the different video resolutions subtracted by 1. The number of different video resolutions may be at least 2.

Exemplarily, the display apparatus according to the embodiments of the present disclosure can be used in any product with display functions such as a display panel, a television, an LCD, an OLED, an electronic paper, a digital photo frame, a mobile phone and a tablet computer.

For example, the number of different video resolutions may be 5, and a GOA group may be designed accordingly. The GOA group may include 4 edge GOA units. Five display areas can be defined based on the 4 edge GOA units and each of the five display areas may correspond to one of the five video resolutions.

In one embodiment, the at least one GOA group may also be two GOA groups positioned at two opposing sides (i.e., the top side and the bottom side, or the left side and the right side) on the display screen. The total number of edge GOA units included in the two GOA groups may be the number of different the video resolutions subtracted by 2. The number of the different video resolutions may be greater than 2.

For example, the number of the different video resolutions may be 5 and two GOA groups, GOA group 1 and GOA group 2, may be designed accordingly. The GOA group 1 may include 2 edge GOA units and 3 areas may be defined by the 2 edge GOA units. The GOA group 2 may include 1 edge GOA unit and 2 areas can be defined by the 1 edge GOA unit. The total number of edge GOA units in the two GOA groups may be 3, equal to the number of the different the video resolution subtracted by 2. Five areas can be defined based on the 3 edge GOA units of the two GOA groups, and each of the five display areas may correspond to one of the five video resolutions.

In one embodiment, the switch control unit may be a TFT. The gate of the TFT may be connected to the control signal. A first terminal (i.e., drain or source) of the TFT may be connected to the corresponding edge GOA unit, and a second terminal (i.e., source or drain) of the TFT may be connected to the previous GOA unit of the current edge GOA unit. In other words, a second terminal (i.e., source or drain) of the TFT may be connected to the previous GOA unit of the current edge GOA unit.

For example, a GOA group may include 1000 stages of GOA units (i.e., from the first-stage GOA unit to the $1000^{th}$-stage GOA unit). The $900^{th}$-stage GOA unit may be an edge GOA unit and may be connected to a TFT. The gate of the TFT may be connected to the control signal. The first terminal (i.e., drain or source) of the TFT may be connected to the $900^{th}$-stage GOA unit and the second terminal (i.e., source or drain) of the TFT may be connected to the $899^{th}$-stage GOA unit.

In one embodiment, when the display area corresponding to any one of the GOA group is not needed to be displayed, no frame-start signal is inputted into the first-stage GOA unit. The frame-start signal connected to the first-stage GOA unit may be used to control the entire GOA group to display images or to stop displaying images. For example, if the frame-start signal is inputted into the first-stage GOA unit, the entire GOA group may be on such that the areas corresponding to the GOA group may display images. If no frame-start signal is inputted into the first-stage GOA unit, the entire GOA group may be off such that the areas corresponding to the GOA group may not display images. Thus, neither additional edge GOA units nor switch control units are needed for turning off all the GOA units in the GOA group. The design of the GOA circuit can be simpler.

In the GOA circuit provided by the present disclosure, the control signal is used for turn off the edge GOA units, in a GOA group, connected to the switch control unit so that the GOA units from the edge GOA units to the last-stage GOA unit may be turned off. Thus, the areas corresponding to the GOA units from the edge GOA units to the last-stage GOA unit may stop displaying when the edge GOA units are turned off. The power consumption of the display apparatus may be reduced.

Figure 4:
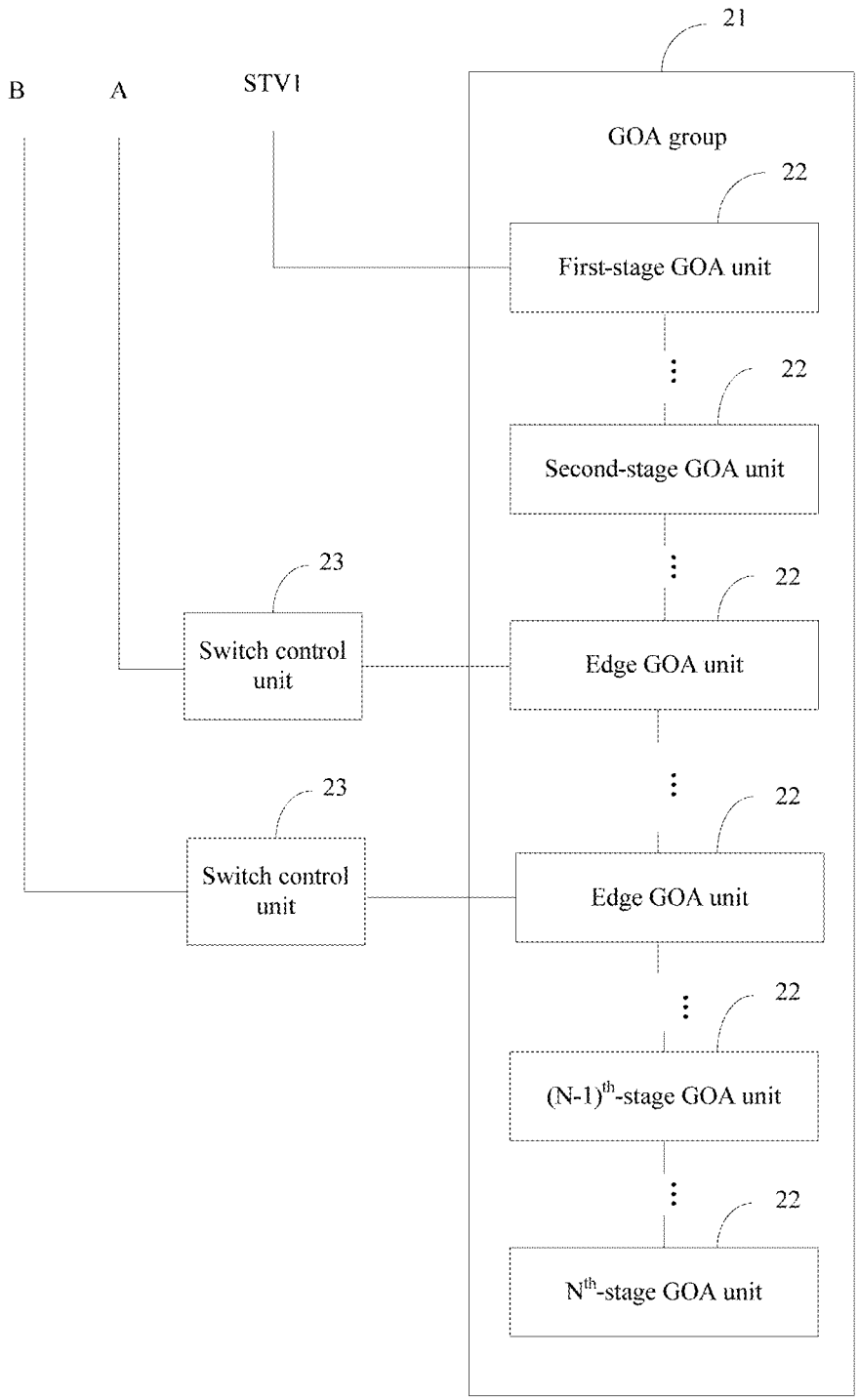
FIG. 4 illustrates block diagram of an exemplary GOA circuit containing a GOA group according to the disclosed embodiments.

The second embodiment provides another exemplary GOA circuit. As shown in FIG. 4, the present disclosure provides another GOA circuit. The GOA circuit may include a GOA group 21, positioned at any side of the display screen of a display apparatus. The GOA group 21 may include N stages of GOA units 22 connected in series, wherein N is an integer greater than 2. The GOA circuit 21 may include M edge GOA units. The M edge GOA units may each be any one of the GOA units except for the first-stage GOA unit and the last-stage GOA unit. M is equal to the number of the different video resolutions subtracted by 1. The number of the different the video resolutions may be at least 2.

In the GOA group 21, the first-stage GOA unit 22 may be connected to the frame-start signal STV1. Each of the edge GOA units 22 may be connected to a control signal (e.g., A or B) through a switch control unit 23. The control signal can be used to turn off the corresponding switch control 23 when the area corresponding to the GOA units 22 from an edge GOA unit 22 to the $N^{th}$ (i.e., last-stage) GOA unit is not needed for displaying images. Thus, the GOA units from the edge GOA unit 22 to the $N^{th}$ GOA unit 22 may be turned off.

The minimum value of M may be 1. That is, the GOA group may only include 1 edge GOA unit. The maximum value of M may be the number of GOA units in the GOA group subtracted by 2. For illustrative purposes, the GOA group shown in FIG. 4 only includes 2 edge GOA units 22. In practice, a GOA group may include a plurality of edge GOA units, such as 1, 3, or 5. The number of edge GOA units is not limited by the embodiments of the present disclosure. A and B may each be a control signal to control a switch control units 23 connected to A and B.

In one embodiment, the display screen may include only one GOA group. That is, M edge GOA units may be used to divide the display screen to (M+1) areas, corresponding to (M+1) video resolutions. For example, the GOA group may include 1 edge GOA unit, and the display screen may be divided into 2 areas corresponding to 2 video resolutions. Alternatively, the GOA group may include 2 edge GOA units, and the display screen may be divided into 3 areas corresponding to 3 video resolutions. Similarly, the GOA group may include more edge GOA units and the number of areas on the display screen can be divided according to the descriptions above. Details are thus not repeated herein.

In one embodiment, any one of the switch control unit 23 may be a TFT. The gate of the TFT may be connected to the control signal. The first terminal (i.e., drain or source) of the TFT may be connected to the corresponding edge GOA unit, and the second terminal (i.e., source or drain) of the TFT may be connected to the previous GOA unit of the current edge GOA unit. In other words, a second terminal (i.e., source or drain) of the TFT may be connected to the previous GOA unit of the current edge GOA unit.

Figure 5:
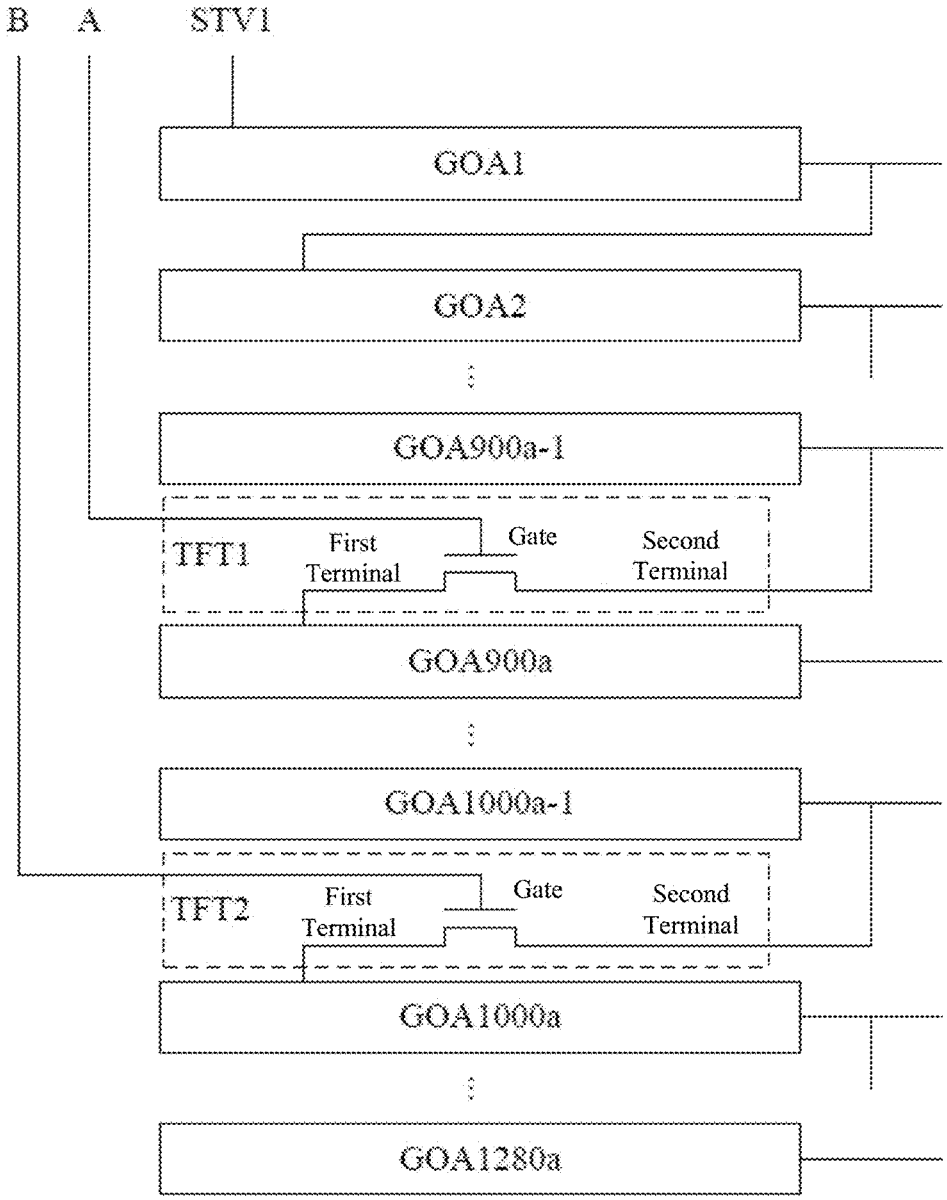
FIG. 5 illustrates block diagram of an exemplary GOA circuit containing two TFTs according to the disclosed embodiments.

For example, FIG. 5 illustrates a structure of a GOA circuit with a GOA group. The GOA group may include a plurality of GOA units, from GOA 1 to GOA 1280a, connected in series. The GOA units, from GOA 1 to GOA 1280a, may correspond to the first TFT row to the 1280a TFT row on the display screen, wherein a is a multiple, with a value such as 1, 2, or 3. The value of a is not limited by the embodiments of the present disclosure.

The GOA circuit may include two edge GOA units. The two edge GOA units may be GOA 900a and GOA 1000a, respectively. GOA 1 (i.e., the first-stage GOA) may be connected to the frame-start signal STV1, and GOA 900a may be connected to TFT 1. The gate of TFT 1 may be connected to the control signal A, the first terminal (i.e., drain or source) of TFT 1 may be connected to GOA 900a, and the second terminal (i.e., source or drain) of TFT 1 may be connected to GOA 900a−1, i.e., the previous GOA unit of GOA 900a. GOA 1000a may be connected to TFT 2. The gate of TFT 2 may be connected to the control signal B. The first terminal (i.e., drain or source) of TFT 2 may be connected to GOA 1000a. The second terminal (i.e., source or drain) of TFT 2 may be connected to GOA 1000a−1, i.e., the previous GOA unit of GOA 1000a. By turning off TFT 1 through control signal A, GOA 900a and GOA 1280a may both be turned off such that the display screen may only display images from the first TFT row to the $(900a-1)^{th}$ TFT row. By turning off TFT 2 through control signal B, GOA 1000a and GOA 1280a may both be turned off such that the display screen may only display images from the first TFT row to the $(1000a-1)^{th}$ TFT row. Thus, certain display areas may not display images.

In the GOA circuit provided by the present disclosure, the control signal is used for turning off the edge GOA units in a GOA group connected to the switch control unit so that the GOA units from the edge GOA units to the last-stage GOA unit may be turned off. Thus, the areas corresponding to the GOA units from the edge GOA units to the last-stage GOA unit may stop displaying. The power consumption of the display apparatus can be reduced. Further, the GOA group may be positioned at one side of the display screen and the design of the GOA circuit may be simpler.

The third embodiment further exemplifies a GOA circuit. The GOA circuit may include two GOA groups positioned at two opposing sides of the display screen. Each of the two GOA groups may include a plurality of GOA units connected in series, and each of the two GOA groups may include at least one edge GOA unit. The edge GOA units may be any one of the GOA units in the corresponding GOA group except for the first-stage GOA unit and the last-stage GOA unit. The total number of the edge GOA units in the two GOA groups may be the number of the different the video resolutions subtracted by 2. The number of the different video resolutions may be greater than 2.

In each GOA group, the first-stage GOA unit may be connected to a frame-start signal, and each edge GOA unit may be connected to a control signal through a switch control unit. The control signal may be used to turn off the corresponding switch control unit when the area corresponding to the GOA units from the edge GOA unit to the last-stage GOA unit when the area is not needed for displaying images. Thus, by turning off the switch control unit, the GOA units from the edge GOA unit to the last-stage GOA unit can be turned off.

Figure 6:
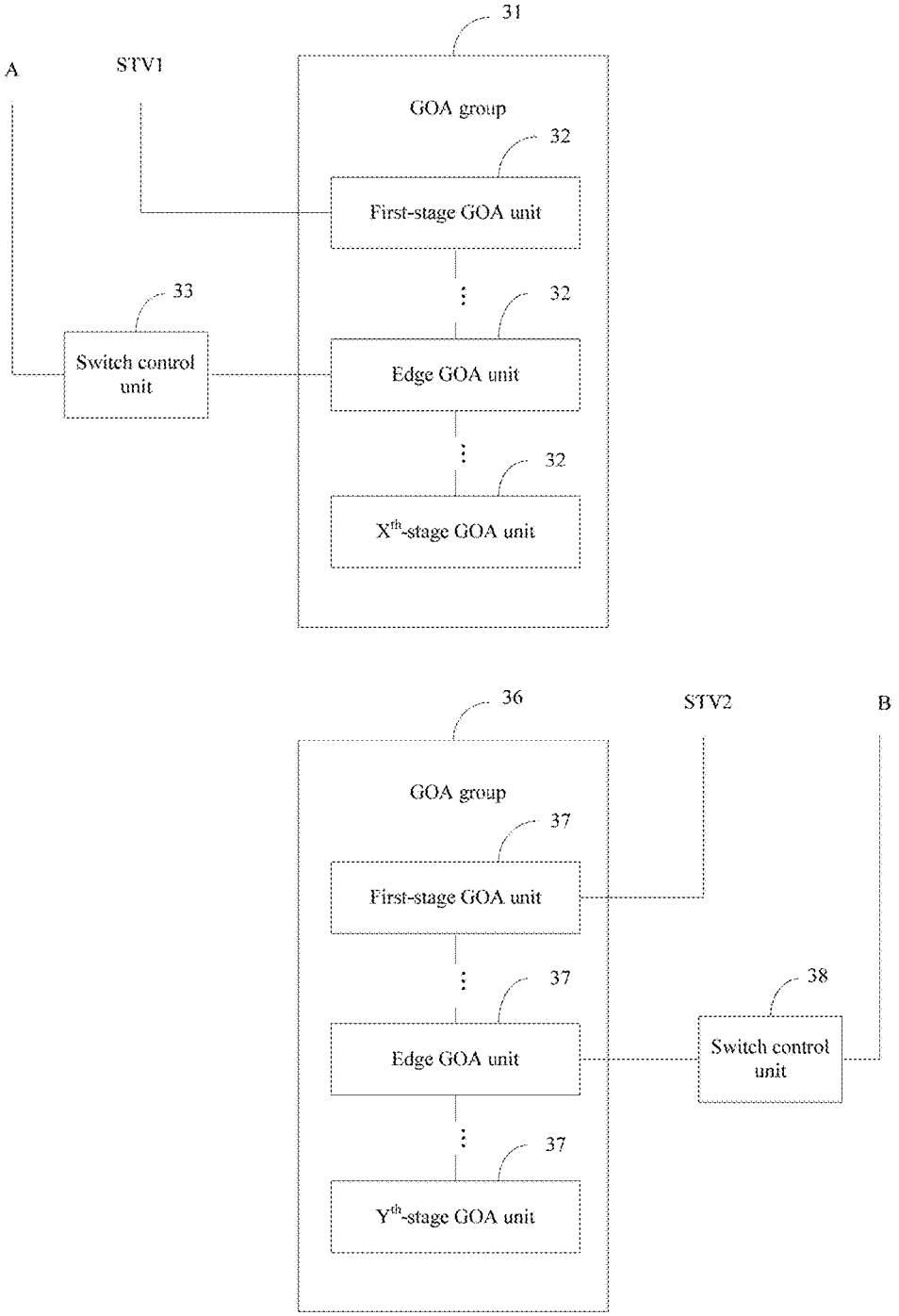
FIG. 6 illustrates block diagram of an exemplary GOA circuit containing two GOA groups according to the disclosed embodiments.

FIG. 6 illustrates the structure of the GOA circuit described above. The GOA circuit may include GOA group 31 and GOA group 36, positioned on two opposing sides of the display screen of a display apparatus. GOA group 31 may include multiple stages of GOA units connected in series, i.e., from the first-stage GOA unit 32 to the $X^{th}$-stage GOA unit 32. One edge GOA unit, selected from the first-stage GOA unit 32 to the $X^{th}$-stage GOA unit 32, may be connected to a switch control unit 33. GOA group 36 may include multiple stages of GOA units connected in series, i.e., from the first-stage GOA unit 37 to the $Y^{th}$-stage GOA unit 37. One edge GOA unit, selected from the first-stage GOA unit 37 to the $Y^{th}$-stage GOA unit 37, may be connected to a switch control unit 38. The first-stage GOA unit 32 in the GOA group 31 may be connected to the frame-start signal STV1, and the control signal A may be used to turn off the switch control unit 33 such that GOA units from the edge GOA unit 32 to the $X^{th}$-stage GOA unit 32 can be turned off. Thus, it can be ensured that the area corresponding to the GOA units from the edge GOA unit 32 to the $X^{th}$-stage GOA unit 32 do not display images. The first-stage GOA unit 37 in the GOA group 36 may be connected to the frame-start signal STV2, and the control signal B may be used to turn off the switch control unit 38 such that GOA units from the edge GOA unit 37 to the $X^{th}$-stage GOA unit 37 can be turned off. Thus, it can be ensured that the display area corresponding to the GOA units from the edge GOA unit 37 to the $Y^{th}$-stage GOA unit 37 do not display images.

In one embodiment, the two GOA groups may be positioned on two opposing sides of the display screen such as the left side and the right side of the display screen, or the top and the bottom of the display screen. The specific positions of the two GOA groups may not be limited by the embodiments of the present disclosure.

In one embodiment, the two GOA groups may be positioned adjacent to each other on the display screen such as on the left side and the bottom of the display screen, or on the right side and the top of the display screen.

Figure 7:
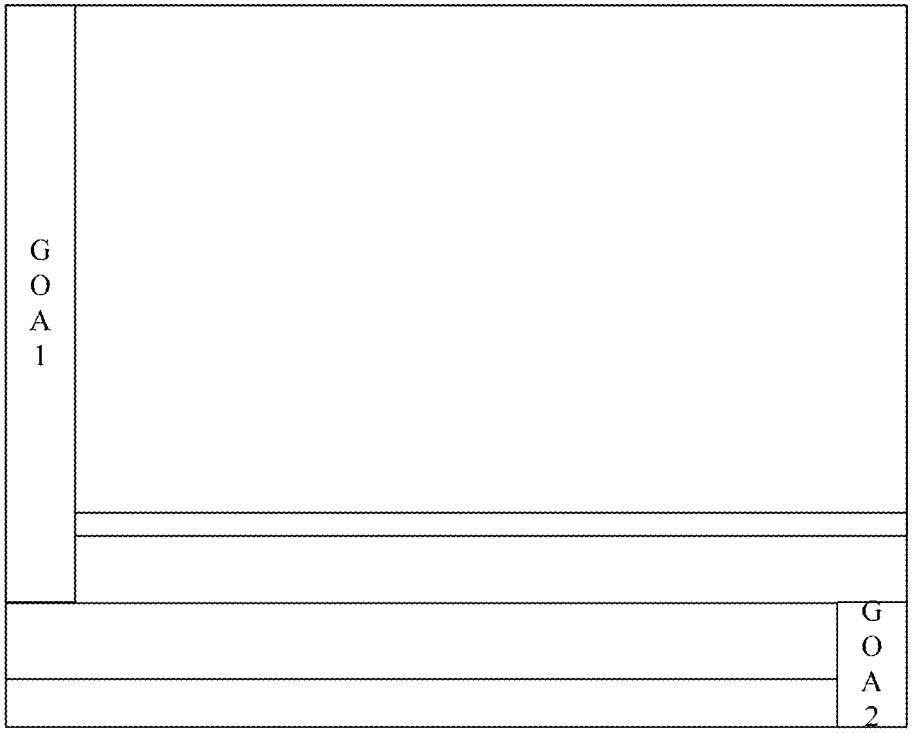
FIG. 7 illustrates layout of the exemplary GOA circuit containing two GOA groups according to the disclosed embodiments.

For example, as shown in FIG. 7, a GOA circuit including two GOA groups is shown. The GOA circuit may include two GOA groups, GOA 1 and GOA 2. GOA 1 may be positioned at the left side of the display screen, controlling three areas on the upper portion of the display screen. GOA 2 may be positioned at the right side of the display screen, controlling two areas on the lower portion of the display screen.

In one embodiment, any one of the switch control units can be a TFT. The gate of the TFT may be connected to the control signal. The first terminal of the TFT may be connected to an edge GOA unit. The second terminal of the TFT may be connected to the previous GOA unit of the current edge GOA unit.

In one embodiment, when the areas corresponding to either one of the GOA groups is not needed for displaying images, no frame-start signal is inputted into the first-stage GOA unit of the corresponding GOA group.

For example, a GOA circuit may include GOA group 1 and GOA group 2. The first-stage GOA unit of GOA group 1 may be connected to the frame-start signal STV1, and the first-stage GOA unit of GOA group 2 may be connected to the frame-start signal STV2. When the areas corresponding GOA group 1 is not needed for displaying images, no frame-start signal STV1 is inputted into GOA group 1. When the areas corresponding GOA group 2 is not needed for displaying images, no frame-start signal STV2 is inputted into GOA group 2.

Figure 8:
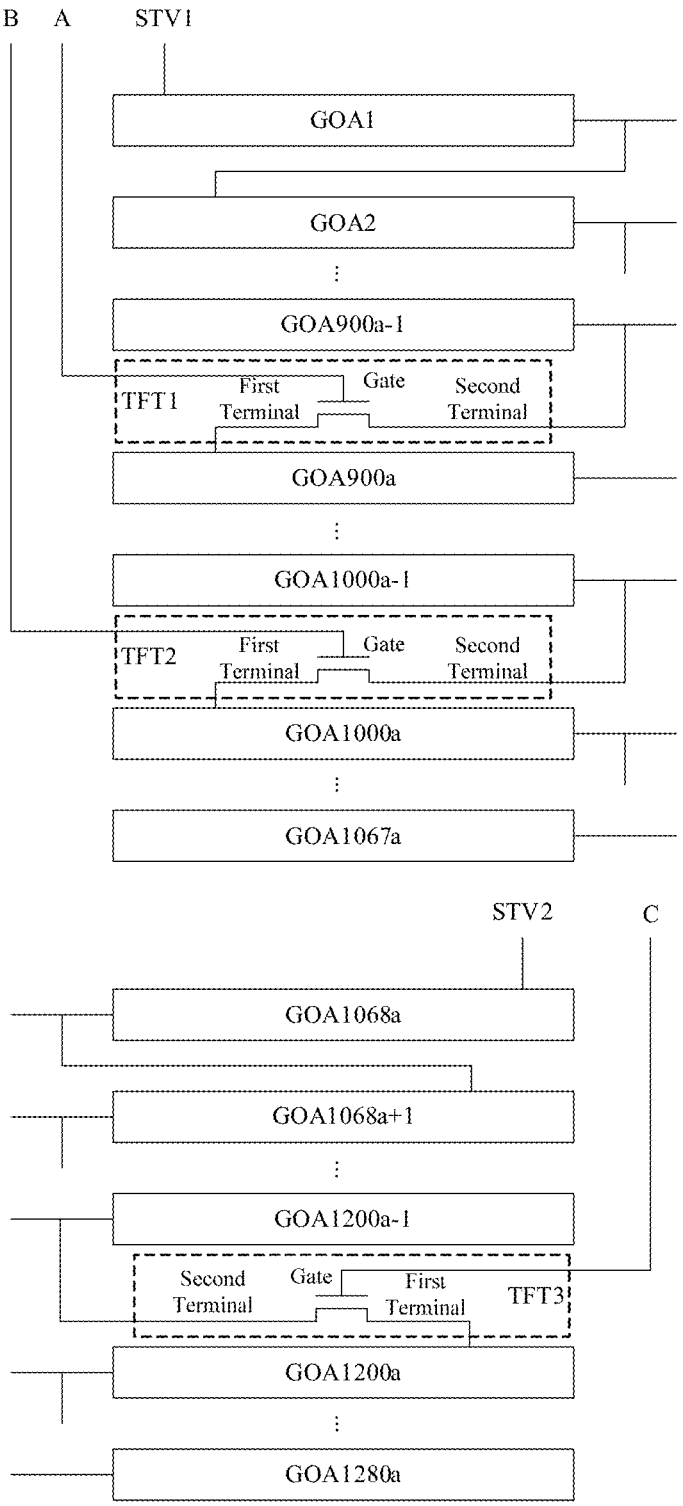
FIG. 8 illustrates an exemplary GOA circuit containing three TFTs according to the disclosed embodiments.

FIG. 8 shows a structure of a GOA circuit with two GOA groups. The GOA circuit may include two GOA groups. The first GOA group may include GOA units from GOA1 to GOA1067a, and the second GOA group may include GOA units from GOA1068a to GOA1280a. The first GOA group may include two edge GOA units, GOA900a and GOA1000a. GOA900a may be connected to TFT1. GOA1000a may be connected to TFT2. GOA1 may be connected to the frame-start signal STV1. Control signal A may be used to turn off TFT1 and control signal B may be used to turn off TFT2. By turning off TFT1 and TFT2, different areas can be controlled to stop displaying images. Details of controlling different areas through the control signals and the switch control units are aforementioned and are not repeated herein.

In the second GOA group of FIG. 8, GOA1068a may be connected to the frame-start signal STV2. GOA1200a may be connected to TFT3. The gate of the TFT3 may be connected to the control signal C. The first terminal of TFT3 may be connected to GOA1200a. The second terminal of TFT3 may be connected to GOA1200a−1 (i.e., the previous GOA unit of GOA1200a). The control signal C may be used to turn off the TFT3 such that the GOA units from GOA1200a to GOA1280a may be turned off. That is, the TFT rows, from the TFT row corresponding to GOA1200a to the TFT row corresponding to GOA1280a, may be turned off. The area corresponding to the TFT rows described above may stop displaying images. Thus, by controlling the two GOA groups, areas can be dynamically controlled to display images or stop displaying images.

In the GOA circuit provided by the present disclosure, the control signal is used for turning off the edge GOA units in a GOA group connected to the switch control unit so that the GOA units from the edge GOA units to the last-stage GOA unit may be turned off. Thus, the areas corresponding to the GOA units from the edge GOA units to the last-stage GOA unit may stop displaying when the edge GOA units are turned off. The power consumption of the display apparatus can be reduced. Further, the two GOA groups may be positioned at two opposing sides of the display screen according to the design of the GOA circuit such that each GOA group can be controlled separately. The GOA circuit may be controlled with more flexibility.

Another aspect of the present disclosure provides a driving method for the GOA circuit.

Figure 9:
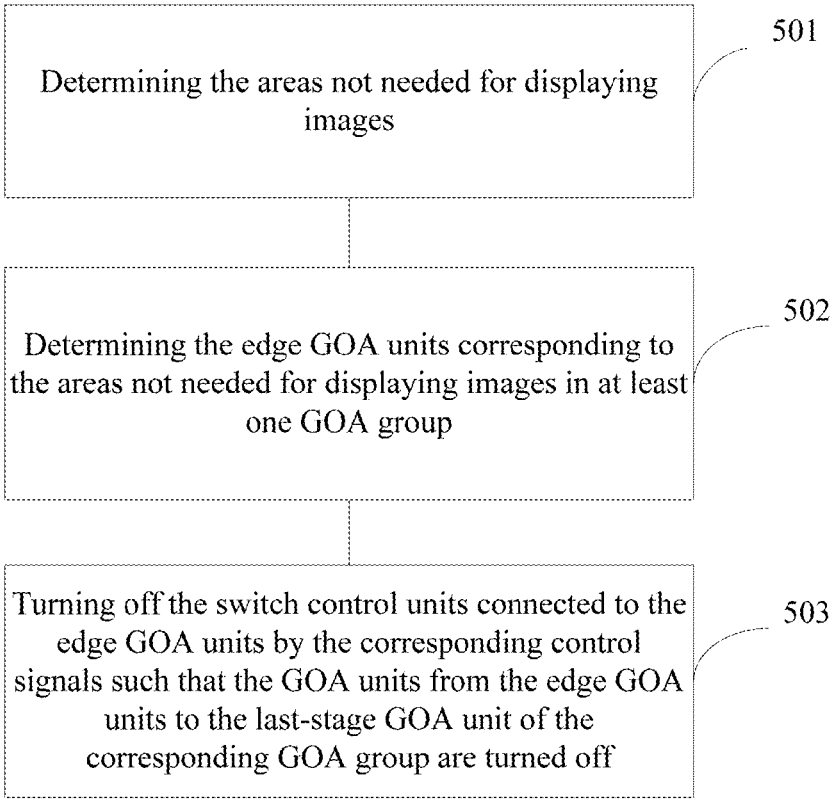
FIG. 9 illustrates an exemplary process of the method for driving the GOA circuits according to the disclosed embodiments.

The driving method can be exemplified in embodiment 4. As shown in FIG. 9, a driving method for the GOA circuit can be provided by the present disclosure to drive the GOA circuit of any one of the disclosed embodiments. The driving method may include steps 501, 502, and 503.

In step 501, the areas not needed for displaying images can be determined.

In step 502, in at least one GOA group, the edge GOA units corresponding to the areas not needed for displaying images can be determined.

In step 503, the switch control units connected to the edge GOA units can be turned off by the corresponding control signals such that the GOA units from the edge GOA units to the last-stage GOA unit of the corresponding GOA group can be turned off.

Figure 10:
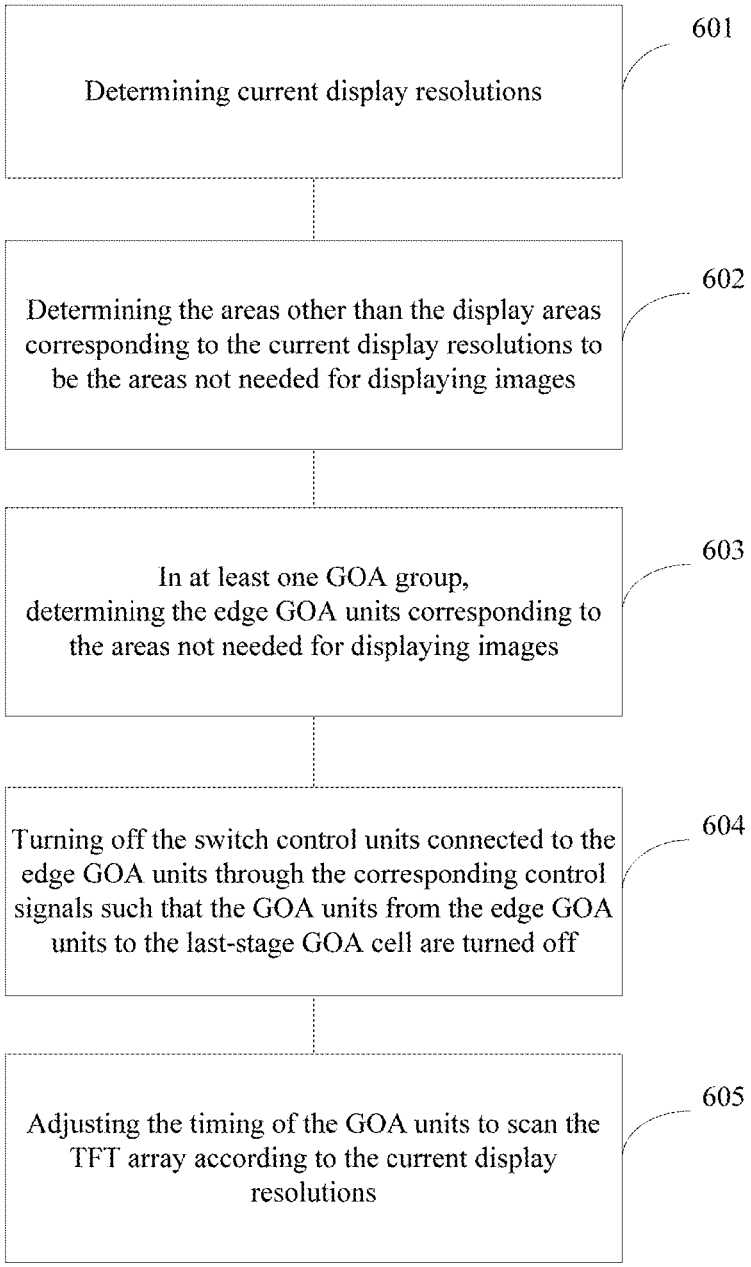
FIG. 10 illustrates another exemplary process of the method for driving the GOA circuits according to the disclosed embodiments.

To accommodate different video resolutions with suitable display areas, the driving method described above may also include steps for adjusting the scan timing, i.e., the timing to scan the TFT array on the display screen. As shown in FIG. 10, the present disclosure further provides a driving method for the GOA circuit. The driving method may include steps 601 to 605.

In step 601, current video resolutions can be obtained.

Often, after a video file is inputted into a display apparatus, the display apparatus may start playing the video file. Video files with different video resolutions can be inputted to the display apparatus. In step 601, the current video resolutions may refer to the video resolutions of the video files that are currently inputted into the display apparatus.

In step 602, the areas other than the areas corresponding to the current video resolutions may be determined as the areas not needed for displaying images.

In step 603, in at least one GOA group, the edge GOA units corresponding to the areas not needed for displaying images can be determined.

In step 604, the switch control units connected to the edge GOA units can be turned off through the corresponding control signals such that the GOA units from the edge GOA units to the last-stage GOA unit of the corresponding GOA group can be turned off.

In step 605, the timing of the GOA units to scan the TFT array can be adjusted according to the current video resolutions.

In one embodiment, the scan timing of the display apparatus may match the video resolutions. Since the GOA units scan the TFT array of the display screen row by row, the scan time of the display screen is fixed when the size of the display screen is fixed. In one embodiment, when the size of the display screen changes, the scan timing of the GOA units may need to be adjusted to ensure the display apparatus can display images normally. Specifically, certain IC (integrated circuits) such as T-CON (timing control) boards can be used to adjust the scan timing such that the scan timing matches the size of the display screen. Details of the operation of the T-CON boards are not repeated herein.

Figure 24:
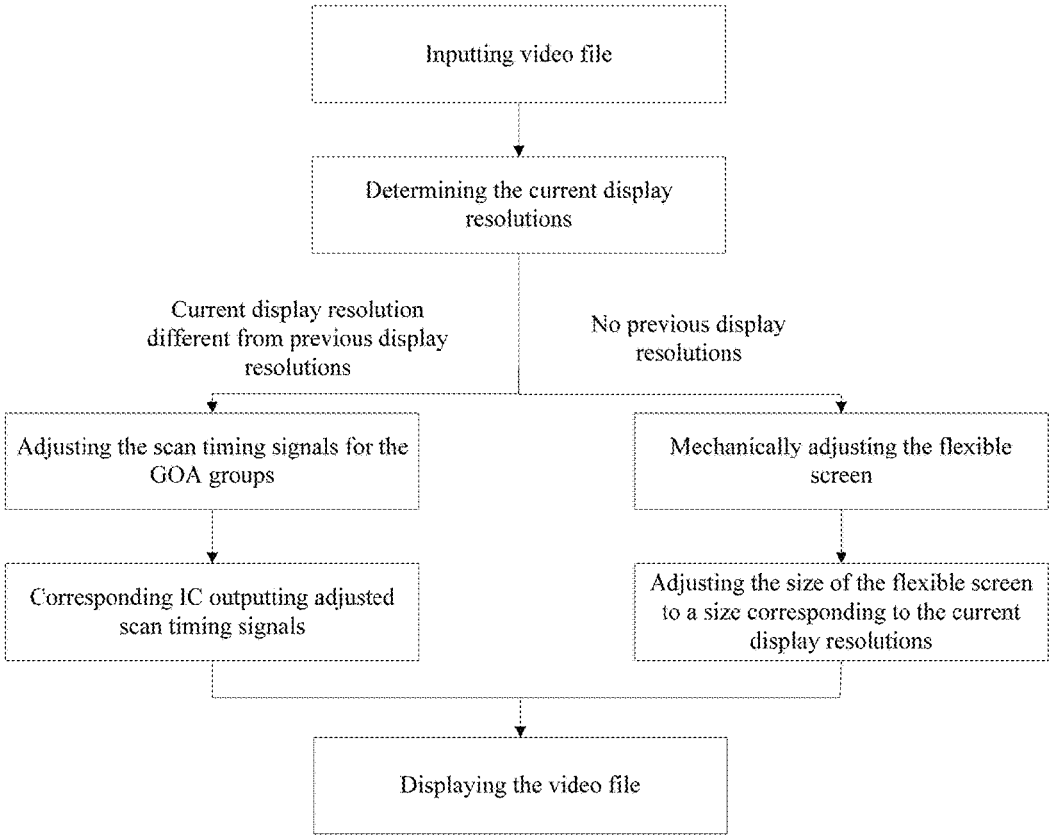
FIG. 24 illustrates another exemplary process of the method for driving the GOA circuits according to the disclosed embodiments.

In one embodiment, as shown in FIG. 24, after a video file is inputted into the display apparatus, current video resolutions of the video file can be determined. If the current video resolutions are different from the video resolutions of a previously displayed video file, the display apparatus may adjust the scan timing signals for the GOA groups. Corresponding ICs may output the adjusted scan timing signal. The display apparatus may scan the TFT array according to the adjusted scan timing signal. The video file can be displayed. If no video file was previously displayed by the display apparatus or no previous video resolution is stored in the display apparatus, the display apparatus may mechanically adjust the display screen such that the display screen is adjusted to a suitable size for the current video resolutions. The video file can then be displayed.

Figure 11:
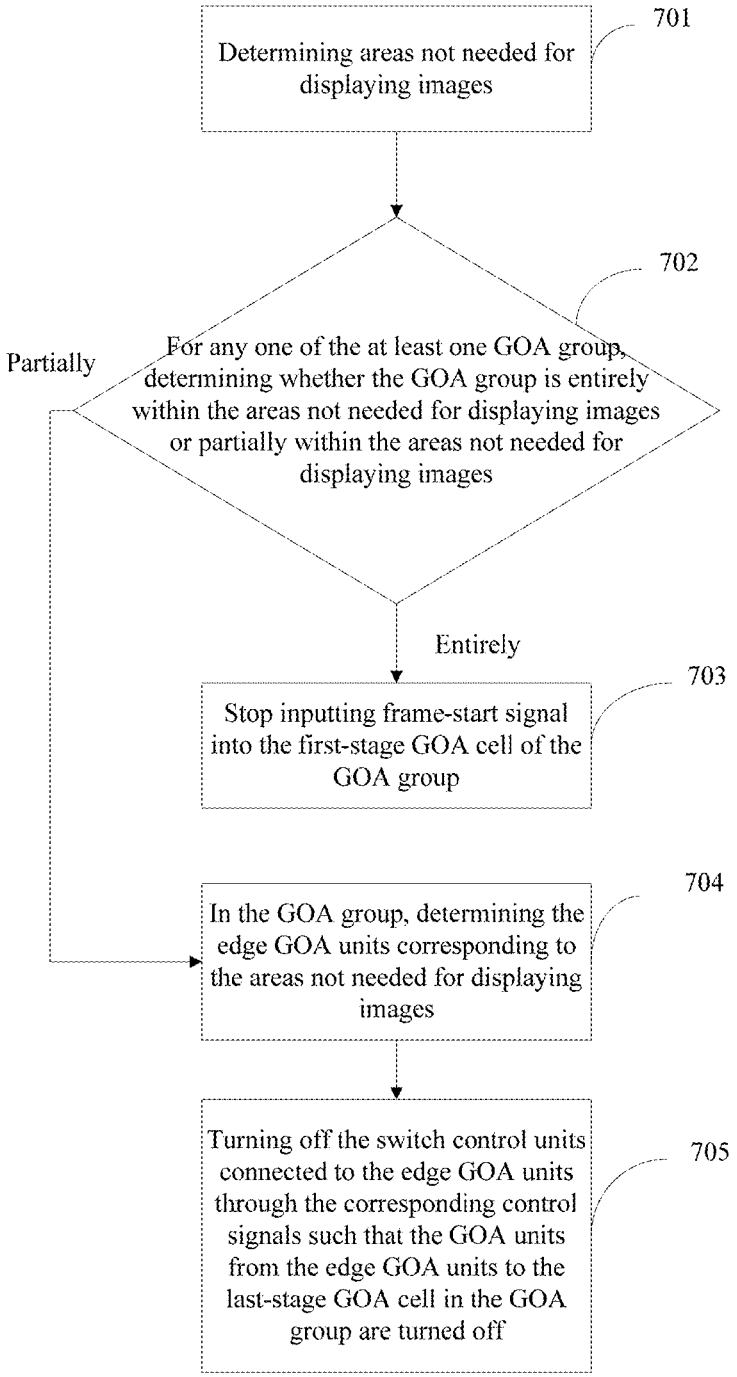
FIG. 11 illustrates another exemplary process of the method for driving the GOA circuits according to the disclosed embodiments.

The present disclosure further provides another driving method for the GOA circuit. As shown in FIG. 11, the driving method may include steps 701 to 705.

In step 701, areas not needed for displaying images can be determined.

In step 702, for any one of the at least one GOA group, the display apparatus may determine whether the GOA group is entirely within the areas not needed for displaying images or is partially within the areas not needed for displaying images. If the GOA group is entirely within the areas not needed for displaying images, the method may proceed to step 703, and if the GOA unit is partially within the areas not needed for displaying images, the method may proceed to step 704.

In step 703, no frame-start signal may be inputted into the first-stage GOA unit of the GOA group and the process ends.

In step 704, in the GOA group, the edge GOA units corresponding to the areas not needed for displaying images can be determined.

In step 705, the switch control units connected to the edge GOA units can be turned off through the corresponding control signals such that the GOA units from the edge GOA units to the last-stage GOA unit in the GOA group can be turned off. The process ends.

In the driving method for the GOA circuit provided by the present disclosure, the control signal is used for turning off the edge GOA units in a GOA group and connected to the switch control unit so that the GOA units from the edge GOA units to the last-stage GOA unit may be turned off Thus, the areas corresponding to the GOA units from the edge GOA units to the last-stage GOA unit may stop displaying images when the edge GOA units are turned off. The power consumption of the display apparatus can be reduced. When the areas not needed for displaying images correspond to a GOA group in the at least one GOA groups, corresponding frame-start signal can be stopped from inputted into the GOA group such that the areas corresponding to the GOA group may stop displaying images. The GOA circuit can thus be better controlled.

Another aspect of the present disclosure further provides a flexible display apparatus.

Figure 12:
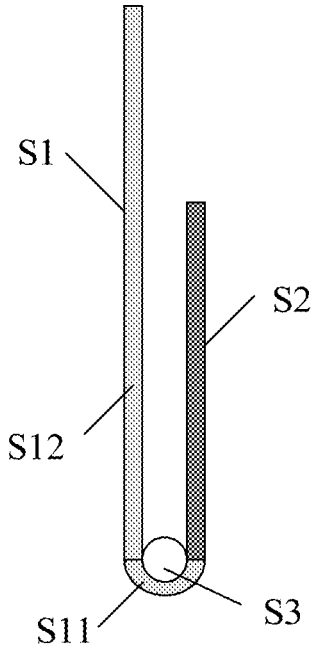
FIGS. 12-19 each illustrates an exemplary flexible display apparatus according to the disclosed embodiments.

The flexible display apparatus can be exemplified in embodiment 5. FIG. 12 illustrates a flexible display apparatus. The flexible display apparatus may include a flexible display screen S1 and any one of the disclosed GOA circuits. The GOA circuit is positioned in the display screen S1 and is not shown in FIG. 12.

At least one side of the flexible display screen S1 may be connected to a movable structure.

The movable structure may include a pulling unit S2 and a shaft S3. The stretchable unit S2 may be connected to the flexible screen S1. The flexible screen S1 may include a first region S11 and a second region S12. When moving in a first direction, the pulling unit S2 may pull the first region S11 of the flexible screen S1 to move around the shaft S3 until the first region S11 and the second region S12 are in different planes. In other words, the pulling unit S2 may pull the first region S11 of the flexible screen S1 to move around the shaft S3 until the first region S11 can't be seen by a user facing the second region S12.

The first region S11 may include the areas not needed for displaying images. The second region S12 may include the areas for displaying images. The first region S11 and the second region S12 may be determined and controlled by the GOA circuit.

In one embodiment, the first region S11 and the second region S12 may not be in the same plane. For example, the first region S11 may be curved, and blocked or shielded by the second region S12 after the first region S11 is curved. The first region S11 may be bent at an angle. The plane containing the first region S11 and the plane containing the second region S12 may form a fixed angle. The first region S11 may wrap around the shaft S3, and the first region S11 may be blocked or shielded by the second region S12.

In one embodiment, more than one movable structures can be connected to the flexible screen S1. For example, the number of movable structures can be 2, 3, or 4. The shape of the flexible screen can be rectangular, squared, rounded, and so on. The shape of the flexible screen and the number of the movable structures are not limited by the embodiments of the present disclosure. Often, the flexible screen is quadrangular, including rectangular and squared.

Figure 13:
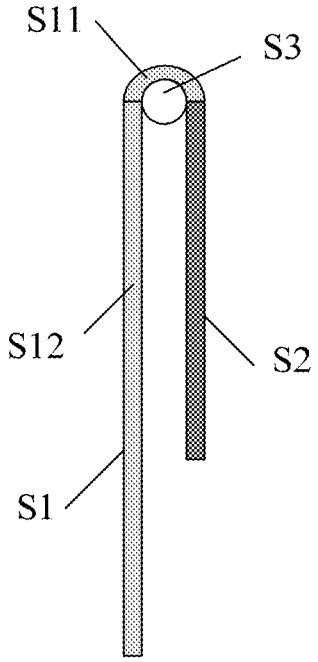
Figure 14:
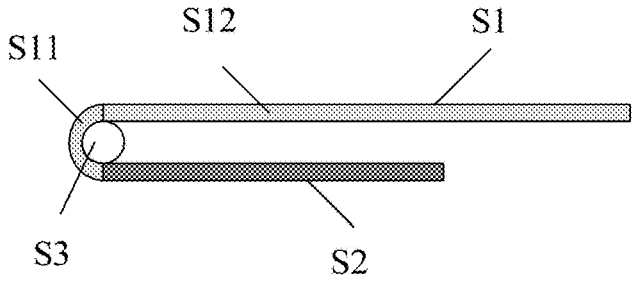
Figure 15:
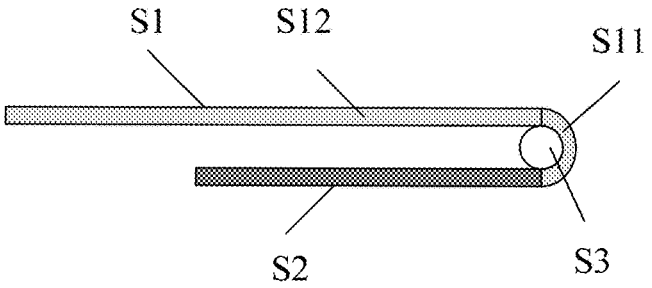

If there is only 1 movable structure, the movable structure can be connected to any side of the flexible screen S1. As shown in FIG. 12, the movable structure may be positioned at the bottom or lower position of the flexible screen S1. The first region S11 may be atop the second region S12. As shown in FIG. 13, the movable structure may also be positioned at the top or upper position of the flexible screen S1. The second region S12 may be atop the first region S11. As shown in FIG. 14, the movable structure may also be positioned at the left side of the flexible screen S1. The first region S11 may be at the left side of the second region S12. As shown in FIG. 15, the movable structure may also be positioned at the right side of the flexible screen S1. The first region S11 may be at the right side of the second region S12.

Figure 16:
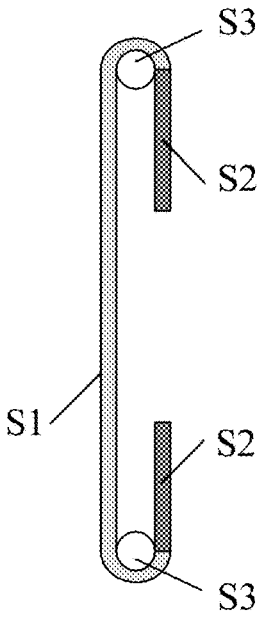
Figure 17:
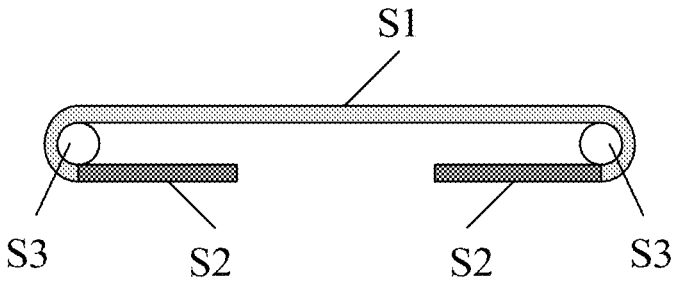

If there are 2 movable structures, the two movable structures can be connected to the flexible screen S1 at two opposing sides (e.g., left side and right side or top and bottom) of the flexible screen S1. The specific positions of the two movable structures are not limited by the embodiments of the present disclosure. FIG. 16 illustrates two movable structures connected to the flexible screen S1, positioned at the top position and the bottom position of the flexible screen S1. FIG. 17 also illustrates two movable structures connected to the flexible screen S1, positioned at the left side and the right side of the flexible screen S1.

Figure 18:
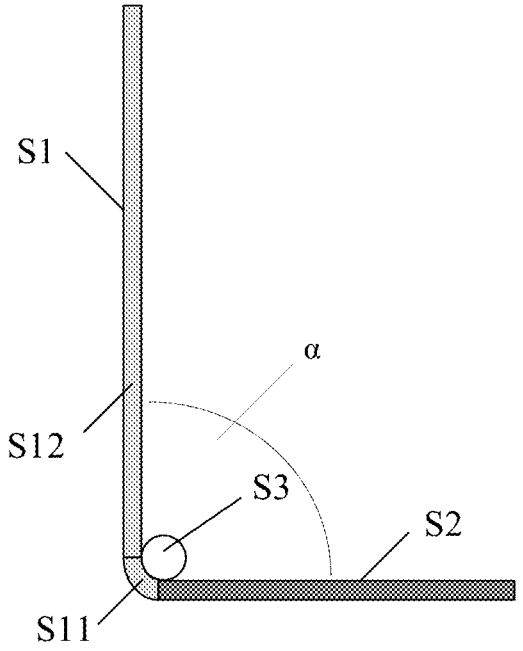

FIG. 18 illustrates one movable structure connected to the flexible screen S1. The movable structure may be positioned at the bottom of the flexible screen S1. The pulling unit S2 may pull the first region S11 of the flexible screen S1 to wrap around the shaft S3 such that the first region S11 is bent at an angle. Thus, the plane containing the first region S11 and the plane containing the second region S12 may form a fixed angle $\alpha$. The fixed angle $\alpha$ may be 30°, 45°, 60°, 90°, and so on. The specific value of the fixed angle $\alpha$ is not limited by the embodiments of the present disclosure.

Figure 19:
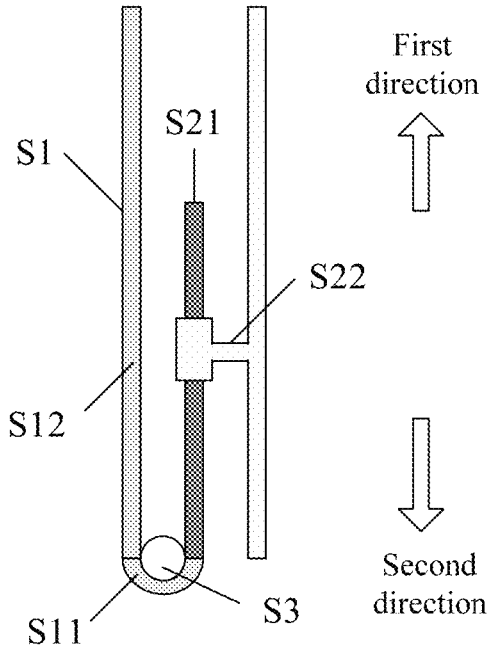

As shown in FIG. 19, the pulling unit S2 may include a rigid strut/support S21 and a gearing structure S22. The rigid strut S21 may be connected to the flexible screen S1. The gearing structure S22 may drive the rigid strut S21 to move in the first direction or in a second direction. The gearing structure S22 may also control the rigid strut S21 to maintain stability so that there would be no movement in other directions. The first direction and the second direction may be opposite to each other. For example, the first direction may be upward and the second direction may be downward, or vice versa.

When the gearing structure S22 drives the rigid strut S21 to move in the first direction, the rigid strut S21 may drive the first region S11 of the flexible screen S1 to move until the first region S11 and the second region S12 are not in the same plane. Further, when the gearing structure S22 drives the rigid strut S21 to move in the second direction, the rigid strut S21 may drive the first region S11 of the flexible screen S1 to move until the first region S11 and the second region S12 are in the same plane. That is, the first region S11 returns to the same plane as the second region S12.

The rigid strut S21 may be connected to the flexible screen S1 through any suitable means to ensure the connection has desired strength. For example, the connection can be formed by adhesion and/or welding. The material of the rigid strut S21 may be any suitable material capable of providing strong support and is not limited by the embodiments of the present disclosure.

As shown in FIG. 19, the rigid strut S21 may move upward and downward repeatedly. The first direction may be upward and the second direction may be downward. When the rigid strut S21 is moving upward, the flexible screen S1 may be driven to bend or curve. The area for displaying images (i.e., the second region S12) may decrease. The bent first region S11 may not display images. Thus, power consumption of the display apparatus can be decreased. When the rigid strut S21 is moving downward, the flexible screen S1 may be driven to expand. The area for displaying images (i.e., the second region S12) may increase to adjust for higher video resolutions.

In one embodiment, the rigid strut S21 may include a plurality of grooves aligned uniformly on both sides of the rigid strut S21. The gearing structure may include at least two gearwheels. Each side of the rigid strut S21 may be engaged tightly with at least one of the gearwheels through the grooves. When the gearwheels, on both sides of the rigid strut S21, rotate simultaneously, the gearwheels may drive the rigid strut S21 to move in the first direction or in the second direction. The gearwheels, on both sides of the rigid strut S21, may also keep/control the rigid strut S21 to be stable in directions other than the first direction and the second direction.

Figure 20:
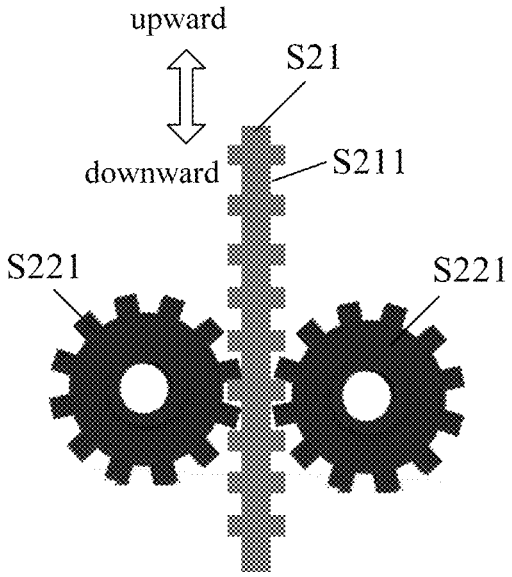
FIG. 20 illustrates an exemplary gearing structure according to the disclosed embodiments.

For example, FIG. 20 illustrates structure of the gearing structure. As shown in FIG. 20, the rigid strut S21 may be positioned at the center or between two gearwheels, and a plurality of grooves S211 may be aligned uniformly on both sides of the rigid strut S21. A gearwheel S221 may be positioned on each side of the rigid strut S21, and the gearwheel S221 may tightly engage with the rigid strut S21 through the grooves S211. When the gearwheels S221 rotate, the gearwheels S221 may drive the rigid strut S21 to move upward and downward repeatedly. The gearwheels S221 may also keep/maintain the rigid strut S21 stable in directions other than the upward and the downward directions. For example, the rigid strut S21 may not move to the right or left, or to the front or back.

Figure 21:
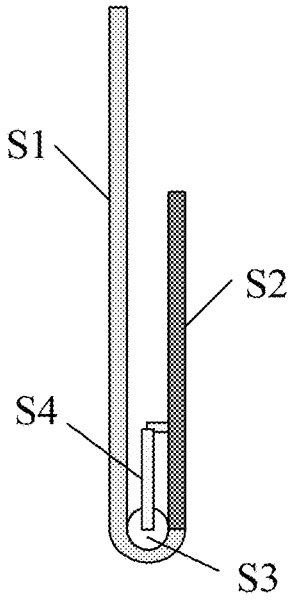
FIG. 21 illustrates another exemplary flexible display apparatus according to the disclosed embodiments.

As shown in FIG. 21, in one embodiment, the movable structure may also include a resilient strut S4. One end of the resilient strut S4 may be fixed on the shaft S3, and the other end of the resilient strut S4 may be fixed on the pulling unit S2 to buffer the movement of the flexible screen S1 around the shaft S3.

When the gearing structure drives the rigid strut to move repeatedly, the resilient strut S4 may move accordingly. Because of resilience, the resilient strut S4 may be stretched (i.e., lengthened) or compressed (i.e., shortened). Thus, the resilient strut S4 may buffer the movement of the flexible screen S1 around the shaft S3.

In one embodiment, the radius of the shaft S3 may not be less than the minimum curving radius of the flexible screen S1 such that the flexible screen S1 may be curved within a permitted range. This is done to reduce or avoid the damages to the flexible screen.

Figure 22:
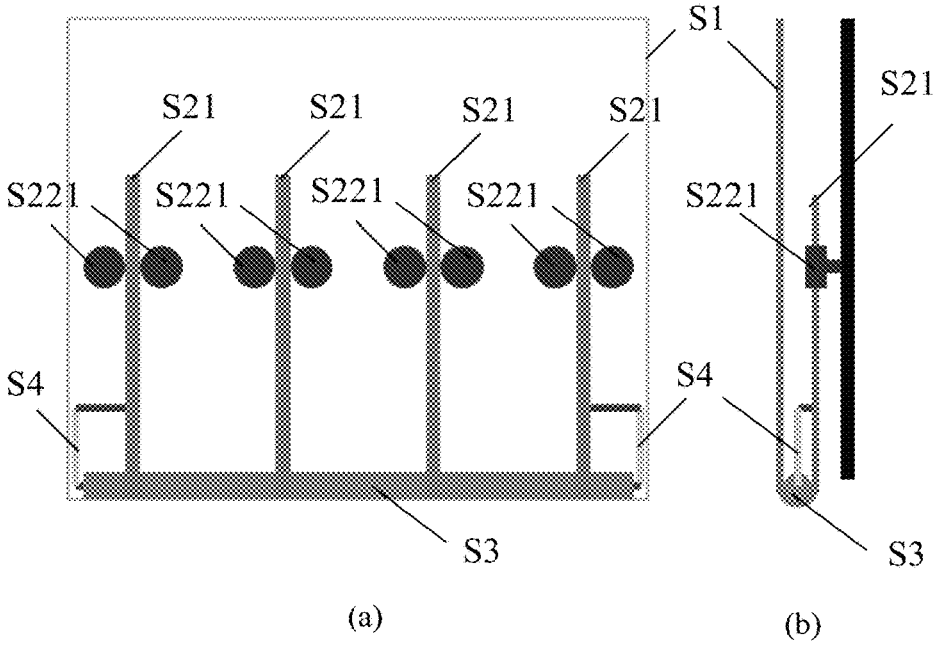
FIG. 22 illustrates rear view and lateral view of the flexible display apparatus according to the disclosed embodiments.

In some embodiments, when using gearwheels in the gearing structure, the number of the rigid strut and the number of the gearwheels are not limited by the embodiments of the present disclosure. For example, FIG. 22 shows the rear view and lateral view of the flexible display apparatus containing the flexible screen described above. FIG. 22(*a*) is the rear view of the flexible display apparatus, and FIG. 22(*b*) is the lateral view of the flexible display apparatus.

As shown in FIG. 22, the movable structure may include four rigid struts S21. Each of the rigid strut S21 may engage with two gearwheels S221 through the grooves (not shown) on both sides of the rigid strut S21. The four rigid struts S21 may be operated together to stretch/pull the flexible screen S1. Two resilient struts S4 are connected to the flexible screen, one on the left side of the flexible screen S1 and the other on the right side of the flexible screen S1. One end of each resilient strut S4 may be fixed to the corresponding rigid strut S21, and the other end of the each resilient strut S4 may be fixed on the shaft S3 to buffer the movement of the flexible screen S1 around the shaft S3.

Any one of the disclosed driving methods for the GOA circuit can be used to operate the flexible display apparatus described above. Details of the operations can be referred to the embodiments aforementioned and are not repeated herein.

In the flexible display apparatus disclosed by the present disclosure, the movable structure is used to move the first region of the flexible screen (i.e., not needed for displaying images) to be in a different plane as the second region of the flexible screen (i.e., for displaying images). No dark border/spacing can be formed, and power consumption of the display apparatus simultaneously. The display effect of the display apparatus can be greatly improved. When the first region is blocked by the second region, visual effect of no dark border/spacing can be achieved and visual experience can be enhanced. In addition, the resilient struts can be used to buffer the movement of the flexible screen, and damages to the flexible screen during the stretching or pulling process can be avoided or reduced. Thus, the flexible display apparatus may ensure the flexible screen not to be damaged.

Another aspect of the present disclosure provides a method for controlling the displaying of the flexible display apparatus.

Figure 23:
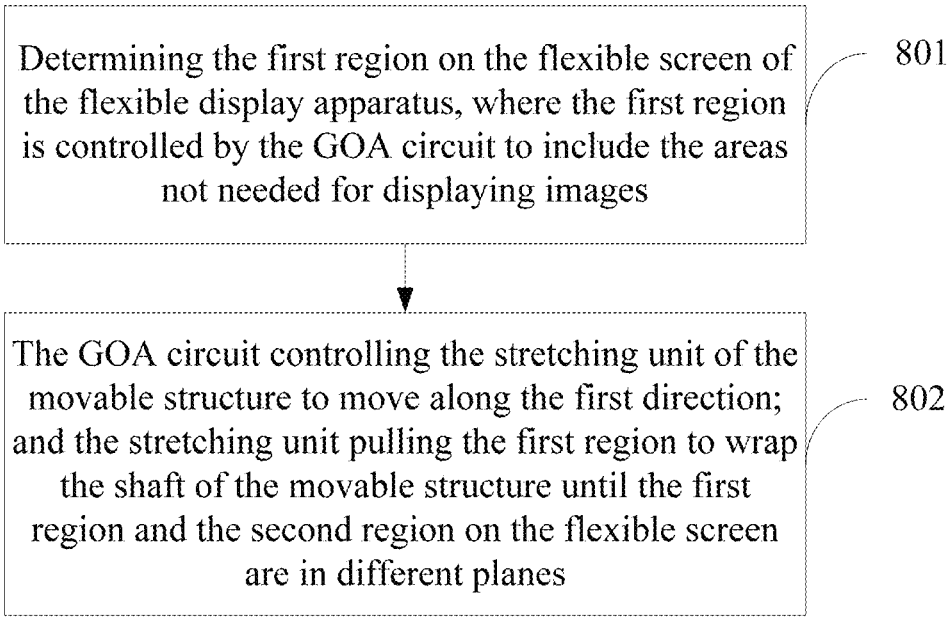
FIG. 23 illustrates an exemplary process of the method for controlling the displaying of the flexible display apparatus according to the disclosed embodiments.

The method for controlling the displaying of the flexible display apparatus can be exemplified in embodiment 6. FIG. 23 illustrates the method for controlling the disclosed flexible display apparatus to display images. The method may include steps 801 and 802.

In step 801, the first region on the flexible screen of the flexible display apparatus can be determined. The first region may be controlled by the GOA circuit to include the areas not needed for displaying images.

In step 802, the GOA circuit may control the pulling unit of the movable structure to move along the first direction. The pulling unit may pull the first region to wrap the shaft of the movable structure until the first region and the second region on the flexible screen are in different planes. The second region may be controlled by the GOA circuit to include the areas for displaying images.

In one embodiment, steps to determine the first region on the flexible screen may include steps 8011 and 8012.

In step 8011, the current video resolutions can be obtained.

In step 8012, the first region on the flexible screen can be determined according to the current video resolutions.

Specifically, the areas corresponding to the video resolutions can be determined as the second region, i.e., the region for displaying images. The areas other than the second region may be determined as the first region, i.e., the region not needed for displaying images.

The steps/process to determine the region not needed for displaying images can be executed by the flexible display apparatus without user operation. The steps/process thus provides faster and more convenient operations.

In another embodiment, steps to determine the first region on the flexible screen of the flexible display apparatus can include steps 8013 and 8014.

In step 8013, the flexible display apparatus may receive control commands with information for determining regions on the flexible screen.

In step 8014, the first region on the flexible screen of the flexible display apparatus can be determined based on the control commands.

The control commands may be triggered or sent by user. The information for determining regions on the flexible screen may refer to the information corresponding to the areas determined by the user as the areas needed for displaying images, or may refer to the information corresponding to the areas determined by the user as the areas not needed for displaying images. The type of information is not limited by the embodiments of the present disclosure. Specifically, when the information corresponds to the areas determined by the user as the areas not needed for displaying images, the areas may be determined as the first region. When the information corresponds to the areas determined by the user as the areas needed for displaying images, the areas other than the areas needed for displaying can be determined as the first region.

For example, the flexible screen of the flexible display apparatus can be divided into three areas, i.e., area 1, area 2, and area 3. When a user requests to adjust the size of areas of the flexible screen, the flexible display apparatus may display the information of the three areas on the flexible screen, such as the label marks of each area and the corresponding size of each area. The flexible display apparatus may also remind the user to select the sizes of areas. When the user selects the sizes of the areas according to the user's needs, the flexible display apparatus may receive the control commands (i.e., corresponding to the user's selection), which contains the information of the displaying areas selected, such as the sizes of the areas for displaying images. The flexible display apparatus may determine the areas corresponding to the information to be the areas for displaying images (i.e., the second region), and determine the areas other than the second region to be the areas not needed for displaying images (i.e., the first region). For example, if the user selects area 2, then area 2 may be determined to be the area for displaying images, and areas other than area 2 (i.e., area 1 and area 3) may be determined to be the areas not needed for displaying images.

The method described above can enable the user to select areas not needed for displaying images, better meet user's needs, and greatly improve flexibility to control the display apparatus. Embodiments of the present disclosure thus improve the user experience.

In one embodiment, the movement of pulling the first region to move around the shaft of the movable structure to pull the first region until the first region and the second region of the flexible screen are in different planes may enable the first region and the second region to be in any one of the following configurations/arrangements. For example, the first region may be curved. The first region may be blocked by the second region after the first region is curved. The first region may be bent at an angle, and the plane containing the first region and the plane containing the second region may form a fixed angle. The first region may wrap around the shaft, and the first region may be blocked by the second region.

In one embodiment, the pulling unit may include at least one rigid strut and at least one gearing structure. Each rigid strut may be connected to the flexible screen, and each gearing strut may drive the corresponding rigid strut to move in the first direction or in the second direction. The gearing structure may control each rigid strut to be fixed in directions other than the first direction and the second direction. The first direction and the second direction may be opposite to each other.

The controlling of moving the first region and the second region in different planes may include controlling the gearing structure to drive each rigid strut to move in the first direction such that each rigid strut may drive the first region to move around the shaft until the first region and the second region are in different planes.

In one embodiment, the controlling of moving the first region and the second region may also include controlling the gearing structure to drive each rigid strut to move in the second direction such that each rigid strut may drive the first region to move around the shaft until the first region returns to the same plane as the second region.

In one embodiment, each of the rigid strut may include a plurality of grooves aligned uniformly on both sides of the rigid strut. The gearing structure may include at least two gearwheels. Each side of a rigid strut may be engaged tightly with at least one of the gearwheels through the grooves.

The controlling of the gearing to move the first region and the second region to be in different planes may include controlling the gearwheels, on both sides of each rigid strut, to rotate simultaneously. The gearwheels may drive the rigid strut to move in the first direction. The rigid strut may drive the first region to move around the shaft until the first region and the second region are in different planes. The gearwheels, on both sides of a rigid strut, may control the rigid strut to be fixed/stable in directions other than the first direction and the second direction.

In the methods provided by the present disclosure, the first region not needed for displaying images can be determined on the flexible screen. The pulling unit of the movable structure can be controlled to move in the first direction such that the pulling unit may pull the first region to move around the shaft until the first region and the second region on the flexible screen are in different planes. Thus, the areas not needed for displaying images do not display images. No dark border/spacing can be formed and power consumption of the display apparatus can be reduced. Visual effect can be greatly improved. When the first region is blocked by the second region, visual effect of no dark border/spacing can be achieved, and visual experience can be improved.

It is known to those skilled in the art that the disclosed embodiments, entirely or partially, can be realized by appropriate hardware or by appropriate software/program commanding suitable hardware. The software/program may be stored in the readable medium of a computer. The readable medium may be ROM (read-only memory), disk, and/or CD-ROM.

Embodiments of the present disclosure provide several advantages. By turning off the switch control unit connected to the edge GOA unit, the GOA units from the edge GOA unit to the last-stage GOA unit can be turned off so that the area on the flexible screen corresponding to the GOA units, from the edge GOA unit to the last-stage GOA unit, do not need to display images. The power consumption of the display apparatus can be reduced. In the flexible display apparatus, by using the movable structure, the first region of the flexible screen (i.e., the region not needed for displaying images) may be moved such that the first region and the second region (i.e., the region for displaying images) are in different planes. No dark border or spacing can be formed and power consumption of the display apparatus can be reduced. Meanwhile, visual effect can be improved and visual experience can be enhanced.

It should be understood that the above embodiments disclosed herein are exemplary only and not limiting the scope of this disclosure. Without departing from the spirit and scope of this invention, other modifications, equivalents, or improvements to the disclosed embodiments are obvious to those skilled in the art and are intended to be encompassed within the scope of the present disclosure.

What is claimed is:

1. A gate driver on array (GOA) circuit for a display screen, comprising:

a plurality of GOA groups, each including a plurality of GOA units comprising a first-stage GOA unit, a last-stage GOA unit, and at least one edge GOA unit connected in series, wherein the plurality of GOA groups are not connected to each other and each of the plurality of GOA groups is configured to be controlled independently; and switch control units, each configured to transmit a corresponding control signal, wherein:

in each of the plurality of GOA groups, the first-stage GOA unit is configured to receive a frame-start signal and the at least one edge GOA unit is configured to receive the control signal through one of the switch control units, and in response to a control signal turning off the corresponding switch control unit, the corresponding edge GOA unit to the last-stage GOA unit are turned off, and the first-stage GOA unit to the GOA unit before the corresponding edge GOA unit are controlled by the frame-start signal.

2. The GOA circuit according to claim 1, wherein a number of the at least one edge GOA unit of the plurality of GOA groups corresponds to a number of different video resolutions of videos to be displayed in the display screen.

3. The GOA circuit according to claim 2, wherein the plurality of GOA groups are divided by one or more edge GOA units to a plurality of display screen areas such that each one of the plurality of display screen areas corresponds to one of the different video resolutions.

4. The GOA circuit according to claim 2, wherein each of the plurality of GOA groups is positioned at one side of the display screen.

5. The GOA circuit according to claim 2, wherein the plurality of GOA groups include two GOA groups positioned at two opposing sides of a display screen; and a number of edge GOA units in each of the plurality of GOA groups is equal to a number of different video resolutions subtracted by 2, the number of different video resolutions being greater than 2.

6. The GOA circuit according to claim 1, wherein:

when a display screen area corresponding to any one of the plurality of GOA groups is not needed for displaying images, no frame-start signal is inputted into the first-stage GOA unit of the one of the plurality of GOA groups.

7. A method for driving a GOA circuit including a plurality of GOA groups, each including a plurality of GOA units comprising a first-stage GOA unit, a last-stage GOA unit, and at least one edge GOA unit connected in series, and switch control units, each configured to transmit a corresponding control signal, in each of the plurality of GOA groups, the first-stage GOA unit being configured to receive a frame-start signal and the at least one edge GOA unit being configured to receive the control signal through one of the switch control units, the method comprising:

determining a display screen area not needed for displaying images;

determining an edge GOA unit corresponding to the display screen area; and turning off the switch control unit connected to the edge GOA unit by turning off a corresponding control signal such that GOA units from the corresponding edge GOA unit to the last-stage GOA unit are turned off, and the first-stage GOA unit to the GOA unit before the corresponding edge GOA unit are controlled by the frame-start signal, wherein the plurality of GOA groups are not connected to each other and each of the plurality of GOA groups is configured to be controlled independently.

8. The method according to claim 7, wherein determining the display screen area not needed for displaying images includes:

determining a current video resolution; and determining the display screen area, other than the display screen areas corresponding to the current video resolution, as the display screen area not needed for displaying images.

9. The method according to claim 8, wherein determining the edge GOA unit corresponding to the display screen area not needed for displaying images includes:

determining whether a GOA group corresponding to the edge GOA unit is entirely within the display screen area not needed for displaying images or is partially within the display screen area not needed for displaying images;

if the GOA group is entirely within the display screen area not needed for displaying images, stopping transmitting the frame-start signal to the first-stage GOA unit of the GOA group; and if the GOA group is partially within the display screen area not needed for displaying images, identifying the edge GOA unit corresponding to the display screen area not needed for displaying images.

10. A flexible screen display apparatus, including:

a flexible display screen and the GOA circuit of claim 1, the flexible display screen including a first region and a second region, the first region including the display screen areas not needed for displaying images, the second region including display screen areas for displaying images, the first region and the second region being controlled by the GOA circuit; and a movable structure connected to at least one side of the flexible display screen.

11. The flexible screen display apparatus according to claim 10, wherein the movable structure includes a pulling unit and a shaft, the pulling unit being connected to the flexible display screen, movement of the pulling unit being arranged to pull the first region of the flexible display screen until the first region and the second region are in different planes.

12. The flexible screen display apparatus according to claim 10, wherein:

the first region is curved, and the first region is blocked by the second region.

13. The flexible screen display apparatus according to claim 11, the pulling unit including a rigid strut and a gearing structure, wherein:

the rigid strut is connected to the flexible screen; and the gearing structure is configured to drive the rigid strut to move along a first direction or a second direction being opposite to the first direction and to control the rigid strut to maintain stability in directions other than the first direction and the second direction.

14. The flexible screen display apparatus according to claim 13, wherein:

when the gearing structure is configured to drive the rigid strut to move in the first direction, the rigid strut drives the first region to move until the first region and the second region are in different planes.

15. The flexible screen display apparatus according to claim 13, wherein:

the rigid strut includes a plurality of grooves aligned uniformly on both sides of the rigid strut;

the gearing structure includes two gearwheels;

each side of the rigid strut is engaged tightly with at least one of the gearwheels through the grooves; and when the gearwheels on both sides of the rigid strut rotate simultaneously, the gearwheels drive the rigid strut to move in the first direction or in the second direction and the gearwheels control the rigid strut to be stable in directions other than the first direction and the second direction.

16. The flexible screen display apparatus according to claim 10, wherein:

the movable structure includes a resilient strut, one end of the resilient strut being fixed on the shaft, and the other end of the resilient strut being fixed on the pulling unit to buffer movements of the flexible screen around the shaft.

17. A method for controlling the flexible display apparatus in claim 13, including:

determining the first region on the flexible display screen of the flexible display apparatus; and moving the pulling unit of the movable structure in the first direction to pull the first region around the shaft of the movable structure until the first region and the second region on the flexible screen are in different planes.

18. The method according to claim 17, further including:

determining current video resolutions; and determining the first region on the flexible display screen of the display apparatus according to the current video resolutions.

19. The method according to claim 17, further including:

receiving control commands with information for determining regions on the flexible display screen; and determining the first region on the flexible display screen of the flexible display apparatus based on the control commands.

20. The method according to claim 17, wherein the first region and the second region are arranged in one of the following configurations:

the first region being curved, and the first region being blocked by the second region; the first region being bent at a fixed angle, and the plane containing the first region and the plane containing the second region forming the fixed angle; and the first region being wrapped around the shaft, and the first region being blocked by the second region.

21. The method according to claim 17, wherein:

the pulling unit includes a rigid strut and a gearing structure; and the rigid strut is connected to the flexible screen.

22. The method according to claim 20, further including:

driving, by the gearing structure, the rigid strut to move in the first direction or in a second direction and control the rigid strut to maintain stability in directions other than the first direction and the second direction, the first direction and the second direction being opposite to each other; and pulling, by the rigid strut, the first region to move until the first region and the second region are in different planes when the gearing structure drives the rigid strut to move in the first direction.

* * * * *